US007762013B2

(12) United States Patent
Hartwick

(10) Patent No.: US 7,762,013 B2
(45) Date of Patent: Jul. 27, 2010

(54) TRENCHER WITH AUTO-PLUNGE AND BOOM DEPTH CONTROL

(75) Inventor: Ty Hartwick, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 142 days.

(21) Appl. No.: 11/771,171

(22) Filed: Jun. 29, 2007

(65) Prior Publication Data

US 2009/0000154 A1 Jan. 1, 2009

(51) Int. Cl.
*E02F 9/22* (2006.01)

(52) U.S. Cl. ..... 37/347; 37/348

(58) Field of Classification Search ..... 37/344, 37/347, 348, 466; 172/2–11; 180/53.2, 336, 180/338, 321, 323, 324, 330, 331; 280/5.508, 280/5.502, 5.51, 755
See application file for complete search history.

(56) References Cited

U.S. PATENT DOCUMENTS

| | | | |
|---|---|---|---|
| 3,750,762 | A | 8/1973 | Eaton |
| 3,876,020 | A | 4/1975 | Barsby |
| 4,013,875 | A | 3/1977 | McGlynn |
| 4,076,090 | A | 2/1978 | Krusche et al. |
| 4,111,066 | A | 9/1978 | Kendrick |
| 4,173,836 | A | 11/1979 | Paurat |
| 4,175,628 | A | 11/1979 | Cornell et al. |
| 4,255,883 | A | 3/1981 | Ealy |
| 4,301,910 | A | 11/1981 | Price |
| 4,423,785 | A | 1/1984 | Kurihara et al. |
| 4,541,497 | A | 9/1985 | Riediger et al. |
| 4,677,579 | A | 6/1987 | Radomilovich |
| 4,699,239 | A | 10/1987 | Ishino et al. |
| 4,702,358 | A | 10/1987 | Mueller et al. |
| 4,715,012 | A | 12/1987 | Mueller, Jr. |
| 4,727,353 | A | 2/1988 | Ruhter |

(Continued)

FOREIGN PATENT DOCUMENTS

| | | |
|---|---|---|
| DE | 27 00 950 B1 | 3/1978 |

(Continued)

OTHER PUBLICATIONS

DC2 Microcontroller, *Sauer Sundstrand*, 3 pages (Mar. 1993).

(Continued)

*Primary Examiner*—Robert E Pezzuto
(74) *Attorney, Agent, or Firm*—Merchant & Gould P.C.

(57) ABSTRACT

A system and process for controlling and actuating an excavation implement during excavation between an above-ground position and an operator specified below-ground position and for maintaining the specified below-ground position once achieved. The actuation of the excavation implement is regulated by use of an operator modifiable relationship between an engine operating speed and an actuator speed. The actuation of the excavation implement is further regulated by use of an operator modifiable relationship between an attachment drive speed and the actuator speed. A computer network controls the actuation of the excavation implement in response to inputs from the operator and feedback from the engine speed, the attachment drive speed, and an actuator position sensor as the excavation implement progresses through the earth. This results in the system maintaining the engine speed and the attachment drive speed at a desired output level when the excavation implement is subject to variations in loading while moving between the above-ground and below-ground positions.

18 Claims, 24 Drawing Sheets

U.S. PATENT DOCUMENTS

| | | | | |
|---|---|---|---|---|
| 4,945,221 | A | 7/1990 | Nielsen et al. | |
| 5,065,320 | A | 11/1991 | Hayashi et al. | |
| 5,065,326 | A | 11/1991 | Sahm | |
| 5,088,020 | A | 2/1992 | Nishida et al. | |
| 5,101,919 | A | 4/1992 | Ossi | |
| 5,182,713 | A | 1/1993 | Kitoh | |
| 5,212,998 | A * | 5/1993 | Testerman | 74/335 |
| 5,293,944 | A | 3/1994 | Matsumoto | |
| 5,297,019 | A | 3/1994 | Zuehike | |
| 5,297,649 | A | 3/1994 | Yamamoto et al. | |
| RE34,576 | E | 4/1994 | Camilleri | |
| 5,325,933 | A | 7/1994 | Matsushita | |
| 5,347,448 | A | 9/1994 | Nam | |
| 5,361,211 | A | 11/1994 | Lee et al. | |
| 5,363,304 | A | 11/1994 | Awano et al. | |
| 5,398,766 | A | 3/1995 | Nakayama et al. | |
| 5,424,623 | A | 6/1995 | Allen et al. | |
| 5,456,333 | A * | 10/1995 | Brandt et al. | 180/336 |
| 5,509,220 | A | 4/1996 | Cooper | |
| 5,544,055 | A | 8/1996 | Cooper | |
| 5,574,642 | A | 11/1996 | Cooper | |
| 5,576,962 | A | 11/1996 | Ferguson et al. | |
| 5,590,041 | A | 12/1996 | Cooper | |
| 5,681,242 | A * | 10/1997 | Bates | 477/180 |
| 5,768,811 | A | 6/1998 | Cooper | |
| 5,893,677 | A | 4/1999 | Haehn et al. | |
| 5,975,214 | A | 11/1999 | Okamura et al. | |
| 6,022,292 | A * | 2/2000 | Goodnight | 477/121 |
| 6,317,669 | B1 | 11/2001 | Kurenuma et al. | |
| 6,371,566 | B1 | 4/2002 | Haehn | |
| 6,729,050 | B2 | 5/2004 | Whitten et al. | |
| 6,766,236 | B1 | 7/2004 | Lamela et al. | |
| 6,851,495 | B2 * | 2/2005 | Sprinkle et al. | 180/53.2 |
| 7,077,345 | B2 | 7/2006 | Byram et al. | |
| 2002/0139013 | A1 | 10/2002 | Hammerle | |
| 2005/0004734 | A1 | 1/2005 | Cripps | |
| 2005/0177291 | A1 | 8/2005 | Strashny et al. | |
| 2005/0278100 | A1 | 12/2005 | Porter | |
| 2006/0011400 | A1 | 1/2006 | Thomas et al. | |
| 2006/0235595 | A1 | 10/2006 | Sawada | |
| 2009/0000156 | A1 | 1/2009 | Hartwick et al. | |
| 2009/0000157 | A1 | 1/2009 | Hartwick | |

FOREIGN PATENT DOCUMENTS

| | | |
|---|---|---|
| EP | 0 803 614 A1 | 10/1997 |
| EP | 0 905 325 A1 | 3/1999 |
| EP | 1 260 716 A1 | 11/2002 |
| JP | 3-70683 | 3/1991 |
| WO | WO 91/02853 | 3/1991 |
| WO | WO 94/02346 | 2/1994 |

OTHER PUBLICATIONS

DP600 Series Graphical Terminals, *Sauer Danfoss*, 2 pages (Jan. 2006).

International Search Report and Written Opinion mailed Oct. 7, 2008.

Introducing Tesmec's all-new Mechanical Series, *Tesmec*, 2 pages pages (Publicly known at least as early as Jun. 29, 2007).

IX024-010-00000 PLUS+1 Input Module, *Sauer Danfoss*, 2 pages (Jan. 2006).

MC050-010-00000 PLUS+1 Controller, *Sauer Danfoss*, 2 pages (Jan. 2006).

MC050-020-00000 PLUS+1 Controller, *Sauer Danfoss*, 2 pages (Jan. 2006).

MCE101C Load Controller, *Sauer Sundstrand*, 3 pages (Feb. 1990).

OX024-010-00000 PLUS+1 Output Module, *Sauer Danfoss*, 2 pages (Jan. 2006).

PLUS+1 GUIDE Starter Kit and Development System, *Sauer Danfoss*, 2 pages (Jan. 2006).

PLUS+1 GUIDE User Manual, *Sauer Danfoss*, pp. 1-450 (Apr. 2007).

International Search Report and Written Opinion mailed Mar. 17, 2009 relating to PCT Application PCT/US2008/068346.

Invitation to Pay Additional Fees with Partial International Search mailed Nov. 4, 2008 relating to PCT Application PCT/US2008/068346.

International Search Report and Written Opinion cited in PCT/US2008/068355 mailed Nov. 5, 2008.

U.S. Non-Final Office Action cited in U.S. Appl. No. 11/770,909 mailed Jul. 21, 2009.

* cited by examiner

TRENCHER WITH AUTO-PLUNGE AND BOOM DEPTH CONTROL

TECHNICAL FIELD

The present invention relates generally to the field of excavation and, more particularly, to a system and process for controlling an excavation implement during excavation.

BACKGROUND

Various types of excavation machinery initiate an excavation operation at an above-ground position 37 and employ a powered excavation tool to penetrate the earth to a specified depth d. Certain excavation machines are designed to initially excavate earth in a generally vertical direction with respect to the ground surface, and then proceed with excavation in a generally horizontal direction. For these and other excavation machines, the time required to complete the initial vertical excavation effort is typically appreciable.

One such excavation machine that performs an initial vertical excavation prior to a horizontal excavation is termed a track trencher. A track trencher 30 excavation machine, shown in FIGS. 1 and 2, typically includes an engine 36 coupled to a left track drive 32 and a right track drive 34 which together comprise a tractor portion 45 of the track trencher 30. An attachment 46, usually mounted on a boom 47, is typically coupled to the rear of the tractor portion 45 and typically performs a specific type of excavating operation.

A ditcher chain 50 is often employed to dig relatively large trenches at an appreciable rate. The ditcher chain 50 generally remains above the ground in a transport configuration 56 when maneuvering the trencher 30 around a work site. During excavation, the ditcher chain 50 is lowered to a below-ground position 39, penetrating the ground and excavating a trench at the desired depth and speed while in a trenching configuration 58.

Another popular trenching attachment is termed a rock wheel 60 in the art, shown in FIG. 3, and may be operated in a manner similar to that of the ditcher chain 50. Additional attachments, such as a TERRAIN LEVELER™, manufactured by Vermeer Manufacturing Company of Pella, Iowa, are also known in the art and are also operated in a similar manner.

A track trencher excavation machine typically employs one or more sensors that monitor various physical parameters of the machine. The information gathered from the sensors is generally used as an input to regulate a particular machine function, and/or to provide an operator with information, typically by transducing a sensor signal for communication to one or more screens 500 or display instruments, such as a tachometer, for example.

As shown in FIG. 4, a manual boom position (up/down) switch 583 is typically provided to allow the operator to control the movement and vertical position of the attachment 46. An auto-plunge switch 585 is typically provided to allow the operator to control the movement and position of the attachment boom 47 in conjunction with engine 36 speed feedback regulation. The feedback regulation typically monitors an engine 36 speed and reduces an attachment boom 47 movement speed during heavy engine loading and increases the attachment boom 47 movement speed during light engine loading. An attachment drive speed control 598 is typically provided to allow the operator to select and adjust the speed of the attachment 46 drive. An engine throttle 506 is typically provided to limit the engine 36 speed. These controls allow the operator to raise and lower the attachment 46 between the above-ground position 37 and the below-ground position 39 and perform an excavation operation termed a plunge-cut.

It is generally desirable to maintain the engine 36 at a constant output level during excavation which, in turn, allows the trenching attachment 46 to operate at a constant trenching output level. In certain applications, it is desired to maintain the engine 36 at its maximum power output level. Controlling the trencher 30 during plunge-cut excavation by employing a feedback control system as disclosed in U.S. Pat. No. 5,768,811, issued Jun. 23, 1998, eliminates the need for the operator to make frequent adjustments to the manual boom position switch 583 in order to maintain the engine 36 at a target engine output level.

There is a desire among the manufacturers of excavation machinery to minimize the difficulty of operating such machines and to increase their productivity while excavating and, more particularly, while plunge-cutting. It is also desired that high levels of productivity are achieved while excavating and plunge-cutting under a variety of operating conditions and environments and that the excavation machinery be tunable and adaptable to these varying conditions. Furthermore, there is another desire among the operators of such excavation machinery to specify the desired depth d to which the excavation machinery excavates and have that depth d automatically maintained without further operator intervention. The present invention fulfills these and other needs.

SUMMARY

The present disclosure relates to a system and method for controlling an excavation implement during excavation between an above-ground position and a below-ground position. The excavation implement is coupled to an excavation machine having an engine. The position and a rate of change in position of the excavation implement are regulated by use of an operator modifiable relationship between an engine speed and a load multiplier. The position and the rate of change in position of the excavation implement are further regulated by use of an operator modifiable relationship between an attachment drive speed and an attachment multiplier. A computer controls the position of the excavation implement and the rate at which the excavation implement is moved in a generally vertical direction while excavating earth between the above-ground and below-ground positions.

Sensors sense performance parameters indicative of engine performance and excavation implement performance as the excavation implement progresses through the earth. The computer modifies actuation of the excavation implement in response to the sensed performance parameters so as to maintain the engine at a target output level when the engine is subject to variations in loading as the excavation implement is moved between the above-ground and below-ground positions. Furthermore, the computer modifies actuation of the excavation implement in response to the sensed performance parameters so as to maintain the excavation implement drive speed at a target speed when the excavation implement is subject to variations in loading as the excavation implement is moved between the above-ground and below-ground positions. The computer response to the sensed performance parameters and the variations in engine and excavation loading may be tuned by an operator setting modifying the relationship between the engine speed and the load multiplier and further tuned by an operator setting modifying the relationship between the attachment drive speed and the attachment multiplier.

In accordance with certain embodiments of the present invention, a track trencher excavation machine includes a boom pivotally mounted to the excavation machine and supporting an endless digging chain. A cylinder, coupled to the excavation machine and the boom, moves the boom between the above-ground position and the below-ground position during excavation. A boom position sensor senses the position of the cylinder and/or the boom and generates a signal communicating this position to the computer. A desired excavation depth is set by an operator setting and communicated to the computer. A controllable valve, responsive to control signals received from the computer or other control device, regulates displacement of the cylinder to modify the rate of boom movement and the boom position. The computer and/or control device, coupled to the engine and the controllable valve, controls the controllable valve so as to modify the rate of boom movement in order to maintain the engine at the target output level as the boom is moved between the above-ground and below-ground positions during excavation. The computer and/or control device, coupled to the attachment drive and the controllable valve, controls the controllable valve so as to modify the rate of boom movement in order to maintain the attachment drive speed at the target speed as the boom is moved between the above-ground and below-ground positions during excavation. The computer and/or control device, coupled to the boom position sensor and the controllable valve, controls the controllable valve so as to modify the position of the boom in order to obtain and maintain the desired excavation depth during excavation.

DETAILED DESCRIPTION

The present invention is directed to a system and method for controlling an excavation implement 51 of an excavation machine while excavating earth between an above-ground position 37 and a below-ground position 39.

Figure 7:
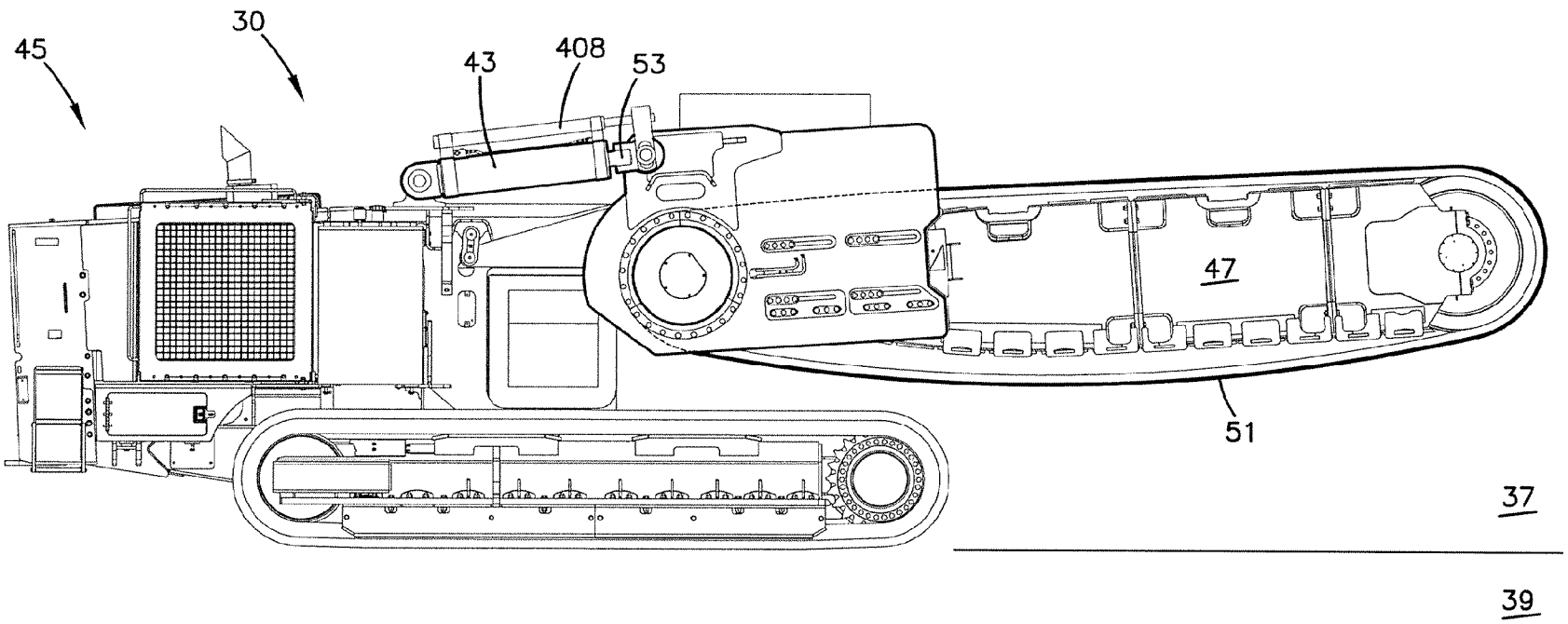
FIG. 7 is a left side view of the track trencher of FIG. 1 depicted with the attachment boom in an above-ground configuration prior to performing a plunge-cut operation.
Figure 8:
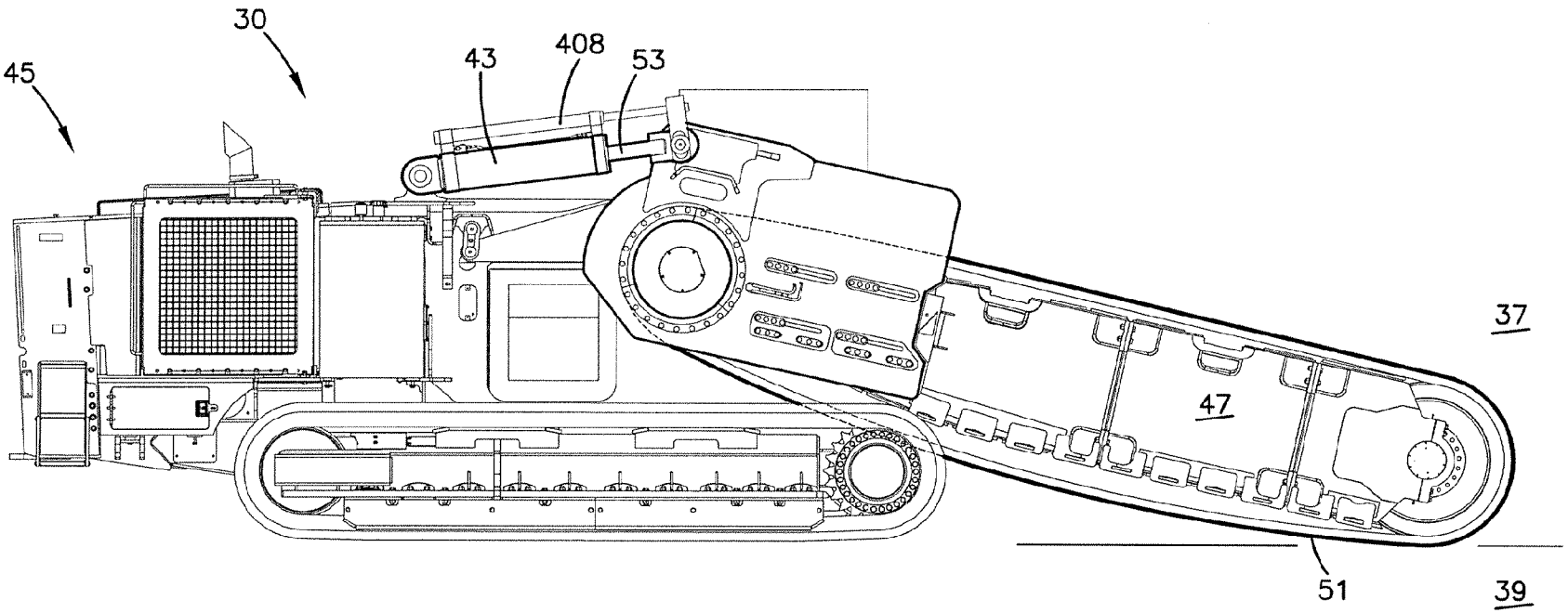
FIG. 8 is a left side view of the track trencher of FIG. 1 depicted with the attachment boom transitioning from the above-ground configuration to the below-ground configuration.
Figure 9:
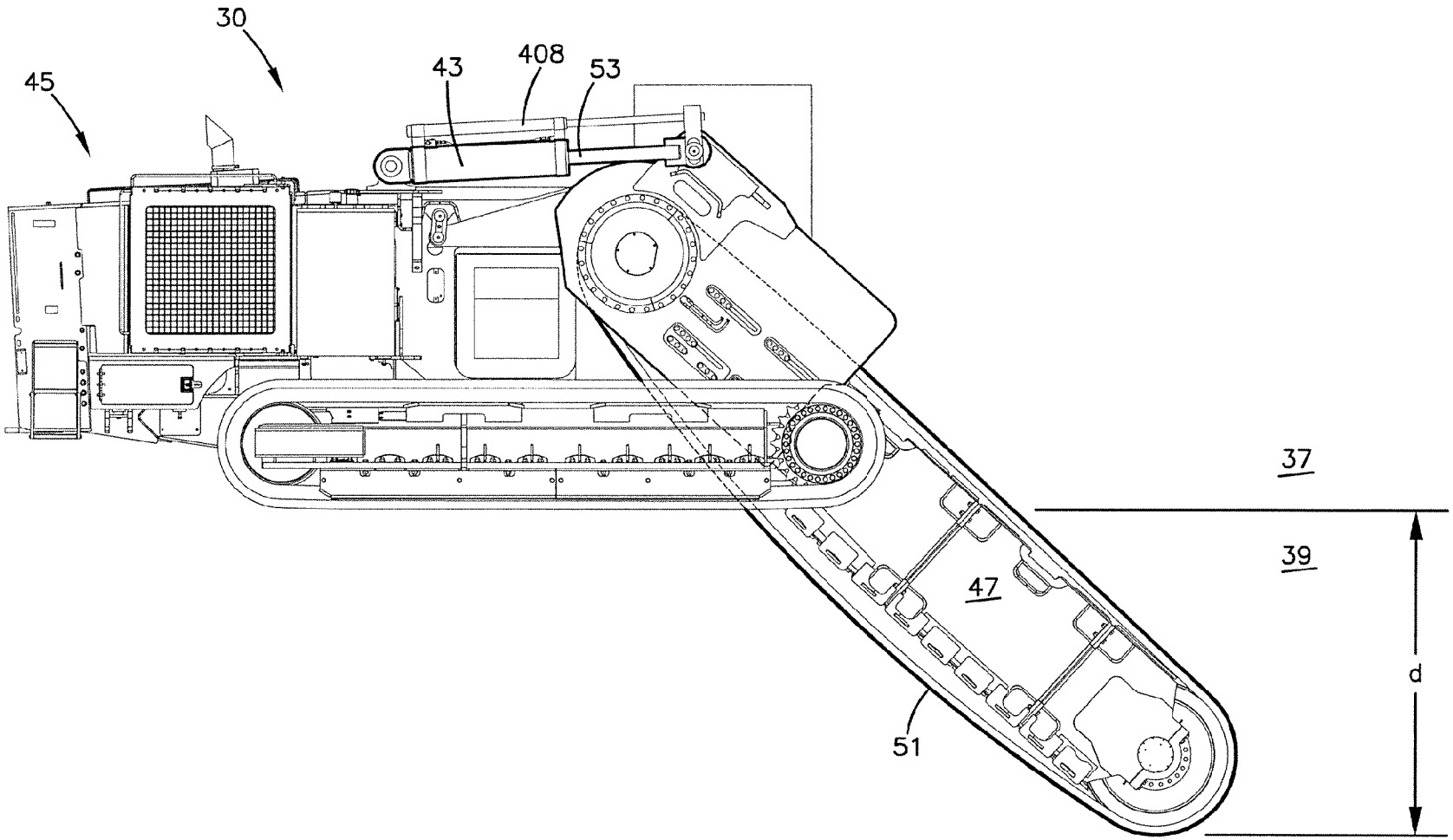
FIG. 9 is a left side view of the track trencher of FIG. 1 depicted with the attachment boom in a below-ground configuration upon completion of the plunge-cut operation.
Figure 10:
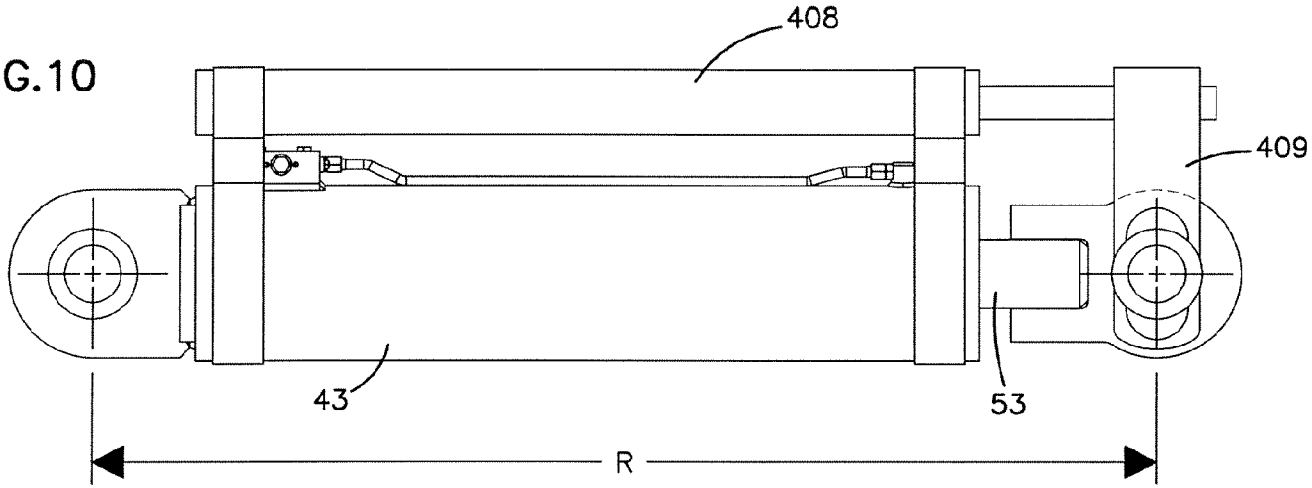
FIG. 10 is a left side view of a boom actuator operably connected to a boom position sensor depicted in a retracted configuration.
Figure 11:
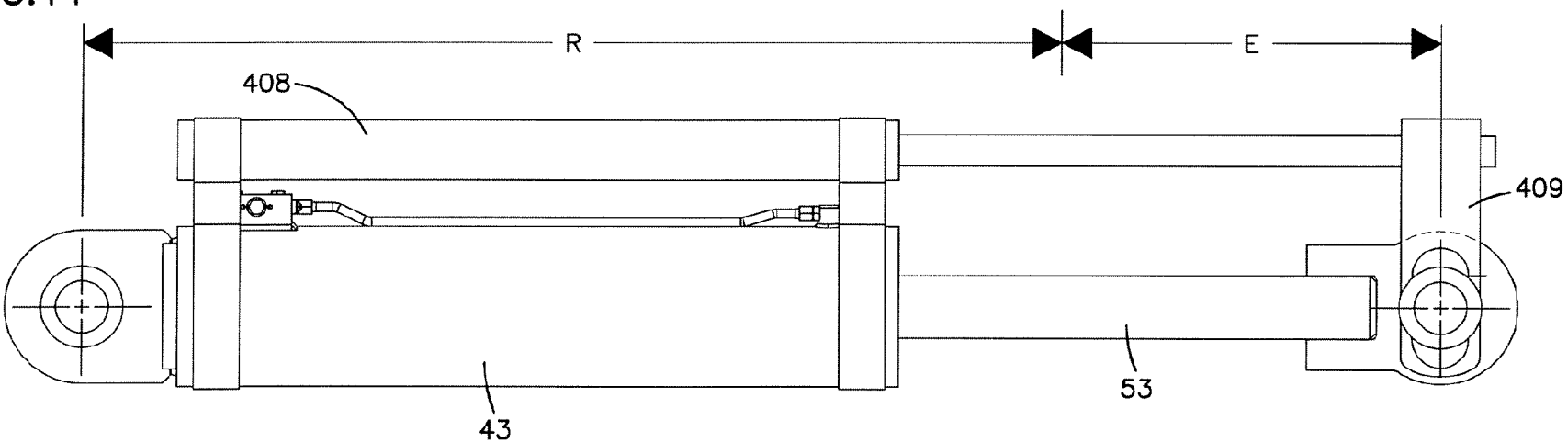
FIG. 11 is a left side view of the boom actuator and the boom position sensor of FIG. 10 depicted in an extended configuration.
Figure 17:
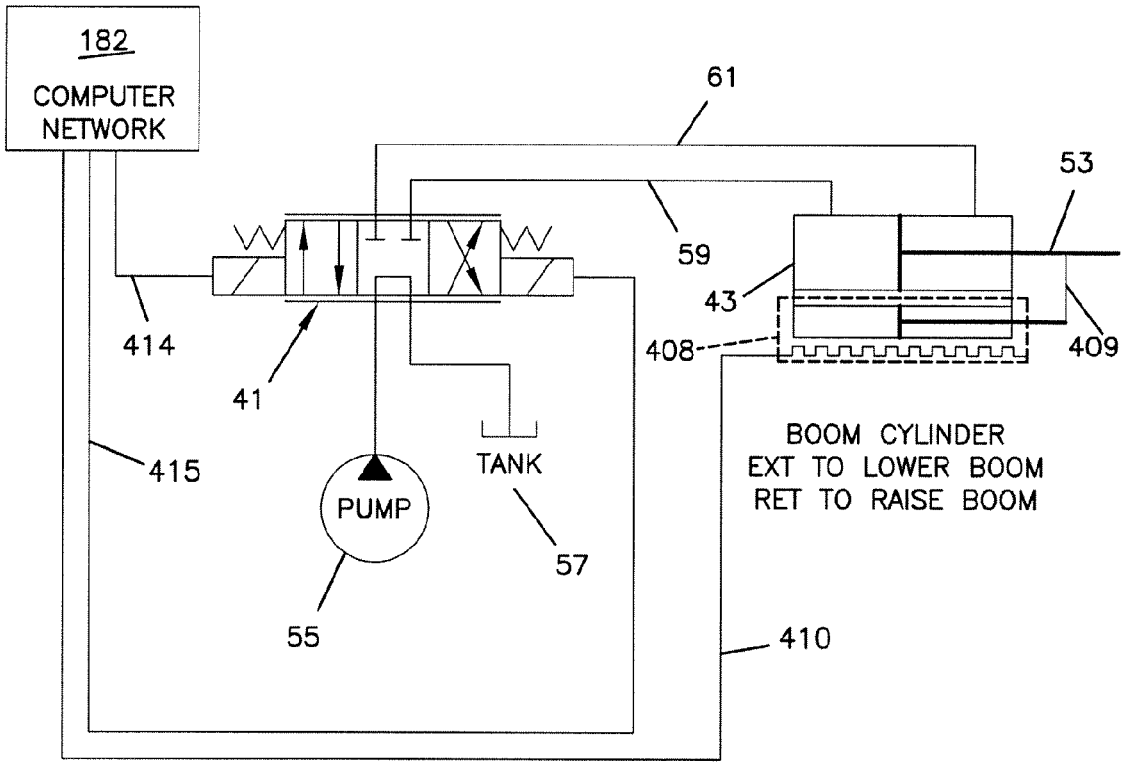
FIG. 17 is a schematic diagram illustrating an embodiment of a controllable valve receiving signals from the computer network and regulating movement and position of the boom actuator with feedback from the boom position sensor.

Referring now to FIGS. 7 through 9, there is illustrated a depiction of a track trencher excavation machine 30 which includes a boom 47 pivotally mounted to a tractor portion 45 of the track trencher 30. The tractor portion 45 including a right track drive 34, a left track drive 32, and an engine 36. The boom 47, upon which an endless digging chain 50 is operably mounted, is moved between the above-ground and below-ground positions 37 and 39 by actuation of a hydraulic cylinder 43 mounted to the boom 47 and the tractor portion 45 of the track trencher 30. The cylinder 43 includes an extendable shaft 53 which is mechanically coupled to the boom 47. Also coupled to the cylinder 43 by a coupler 409 is a boom position sensor 408, as shown in FIGS. 10 and 11 which provides a boom position signal 410 to a computer network 182. As shown in FIG. 17, a controllable valve 41 regulates the flow of hydraulic fluid to the hydraulic cylinder 43 in response to a boom down valve control signal 414 and a boom up valve control signal 415 generated by the computer network 182, as will be described in greater detail hereinbelow.

In an example configuration, the computer network 182 includes a plurality of controllers and other components compliant with a PLUS+1™ standard defined by Sauer-Danfoss, Inc. of Ames, Iowa. Example controller modules include an MC050-010 controller module, an MC050-020 controller module, an IX024-010 input module, and an OX024-010 output module all of which are sold by Sauer-Danfoss, Inc. of Ames, Iowa. In an example configuration, various parameters are stored in a non-volatile memory and a software code is held in an EPROM.

Figure 12:
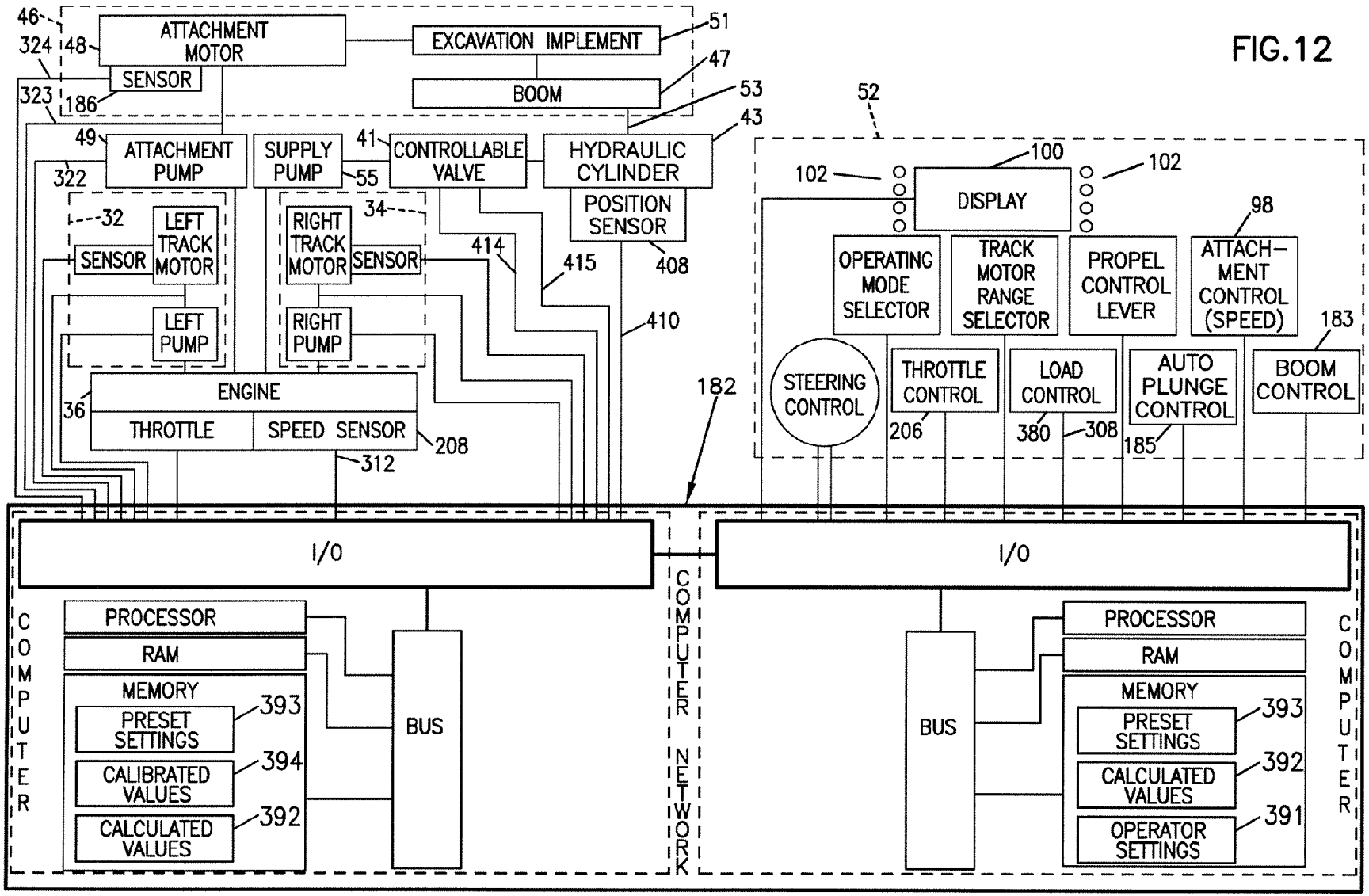
FIG. 12 is a block diagram illustrating a computer network for controlling the plunge-cutting operation of the track trencher boom employing the load control knob, the auto-plunge enable switch, the manual boom control, the boom position sensor, and the display with menu navigation and selection buttons.

As shown in FIGS. 7 through 9 and 12, the boom 47 is a component and main framework of an attachment 46 which is further comprised of an attachment drive motor 48, preferably deriving power from an attachment drive pump 49. A speed sensor 186 is preferably coupled to the attachment drive motor 48 and generates an attachment drive speed signal 324. The attachment drive pump 49, deriving power from the engine 36, preferably regulates hydraulic oil flow to the attachment drive motor 48 which, in turn, provides power for the attachment 46. The attachment drive pump 49 preferably responds to instructions communicated by an attachment drive pump signal 322 determined by the computer network 182 as illustrated in FIG. 12. Alternatively, the attachment control may operate on the attachment motor 48. One or more attachment drive motors 48 and one or more attachment drive pumps 49 may be used together in a parallel hydrostatic circuit.

In certain embodiments of the present invention, actuation of the attachment drive motor 48 is monitored by the speed sensor 186. The output signal 324 produced by the sensor 186 is communicated to the computer network 182. In certain embodiments of the present invention, the operational hydraulic pressure created between the attachment drive motor 48 and the attachment drive pump 49 is monitored by a pressure sensor and communicated by an attachment hydrostatic drive pressure signal 323 to the computer network 182.

Figure 1:
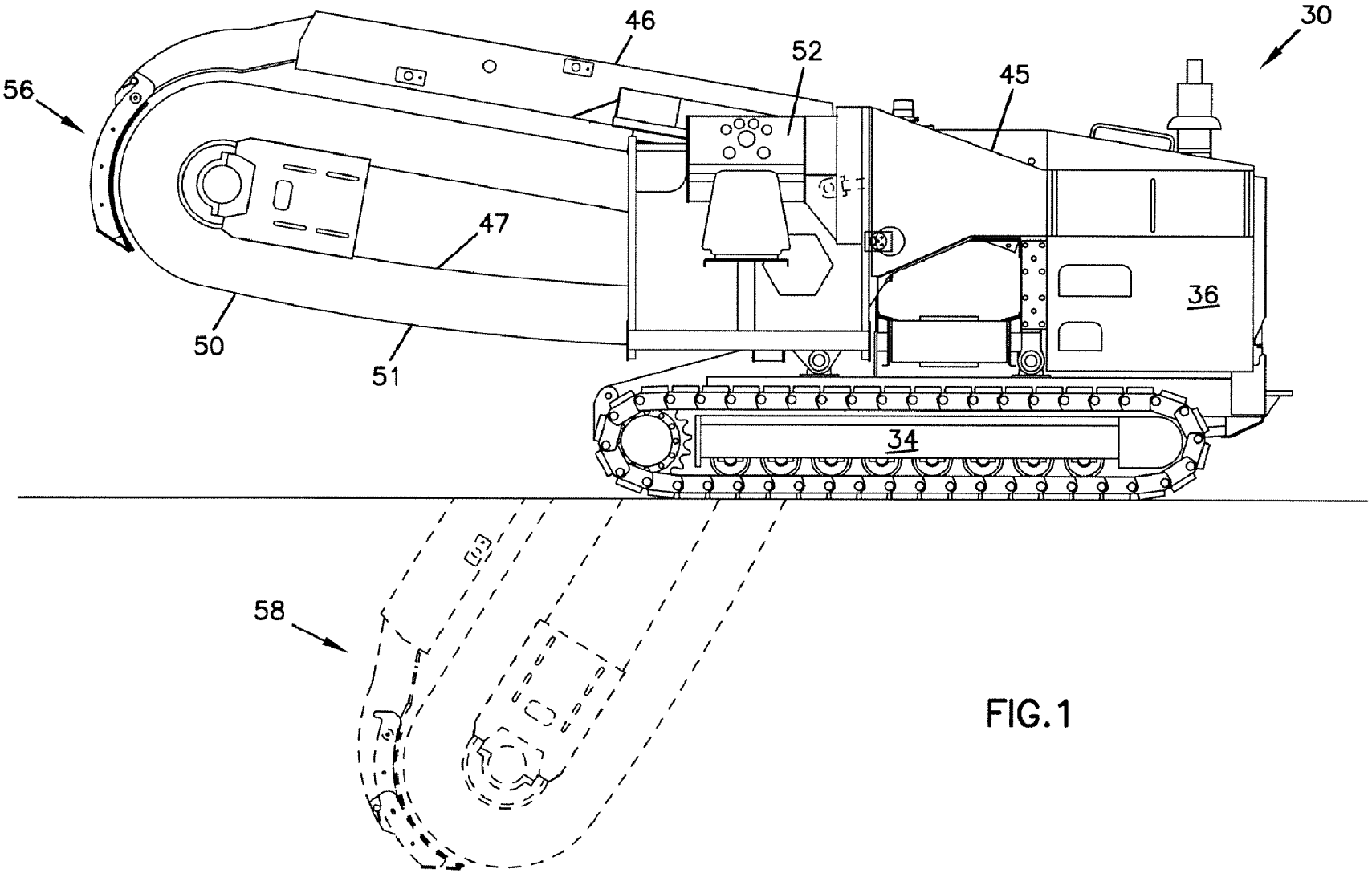
FIG. 1 is a right side view of a track trencher, including a ditcher chain trenching attachment operably mounted on an attachment boom.
Figure 2:
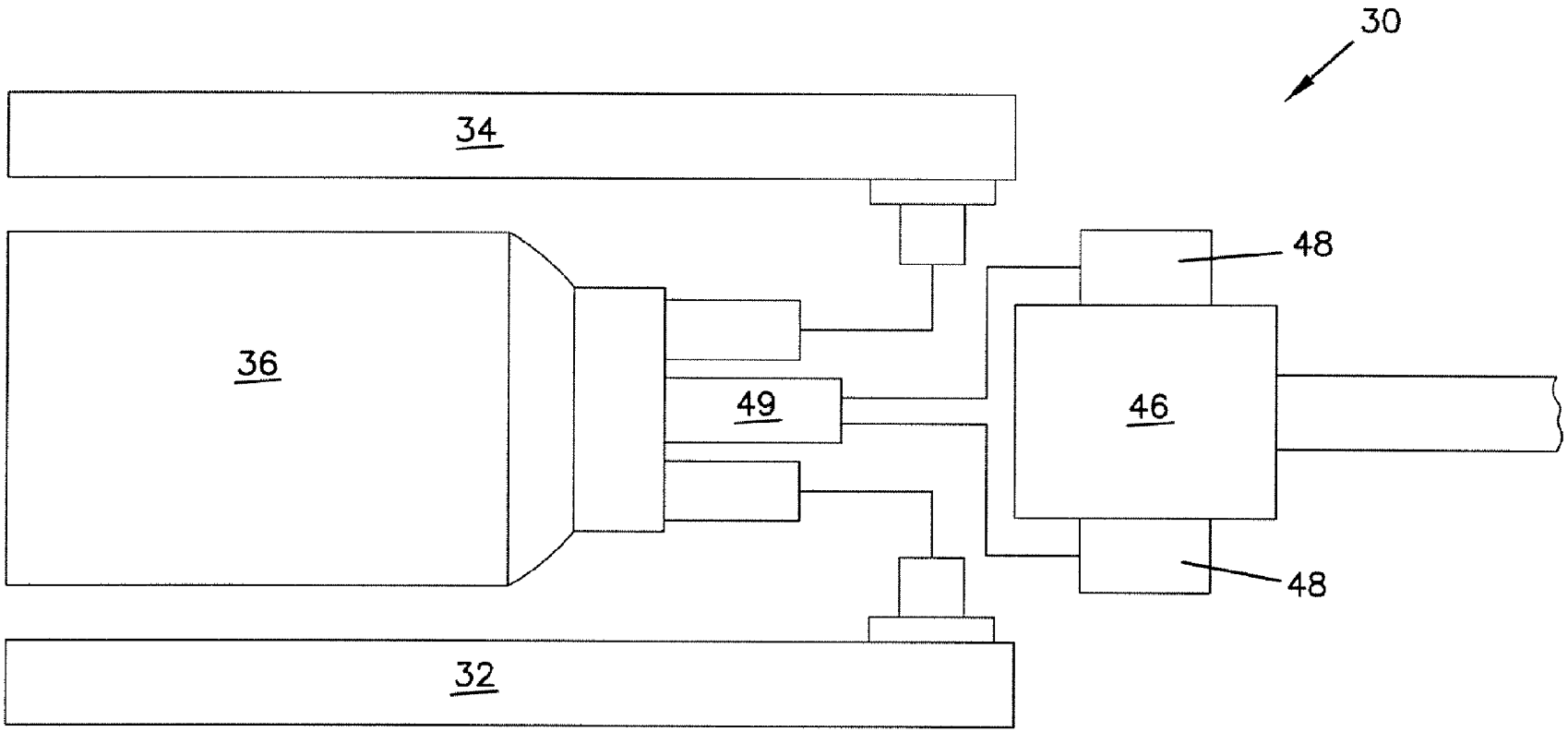
FIG. 2 is a generalized top view of the track trencher, including a right track drive, a left track drive, and an attachment drive.
Figure 3:
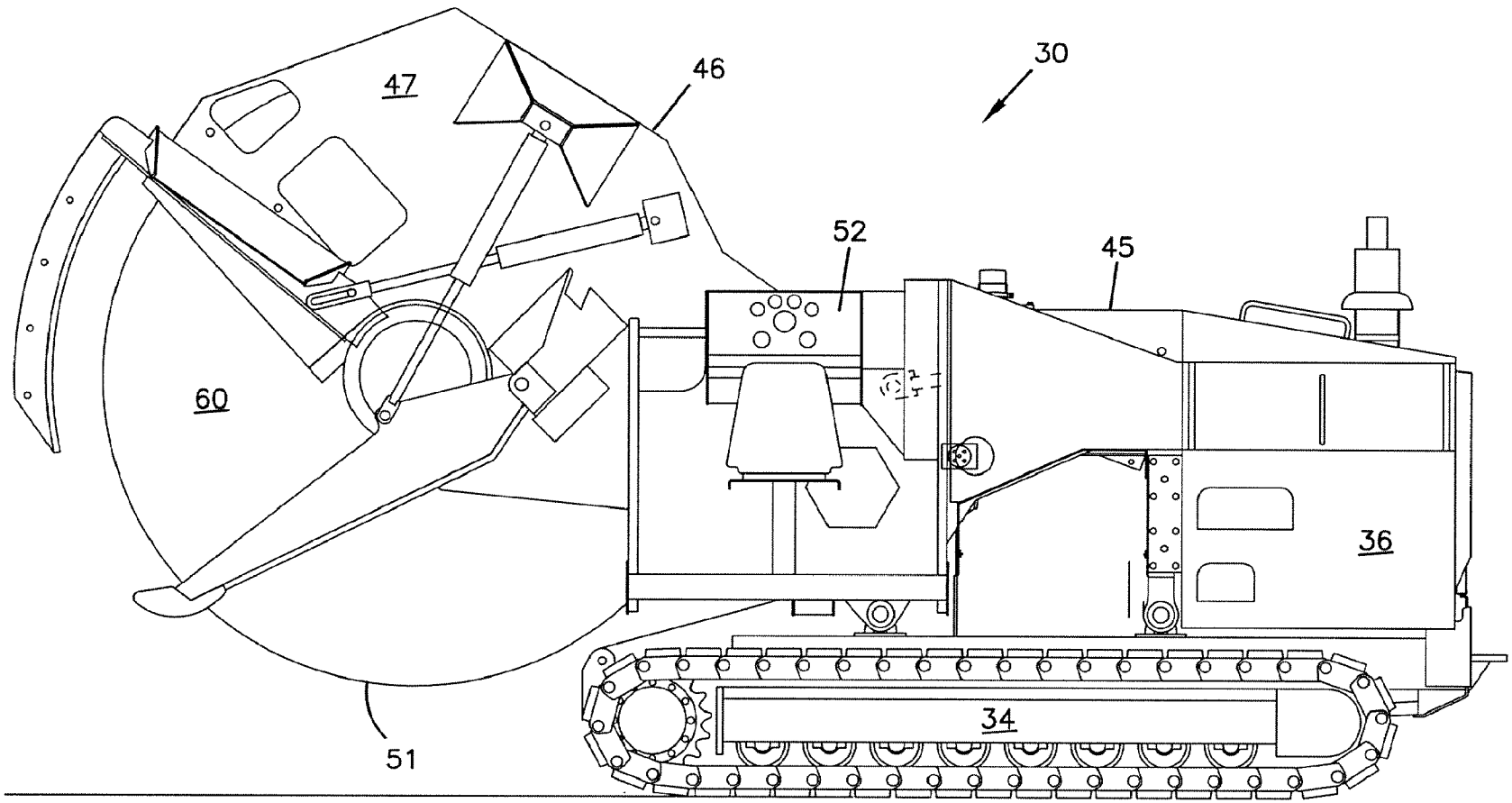
FIG. 3 is a right side view of the track trencher with a rock wheel trenching attachment coupled thereto.
Figure 4:
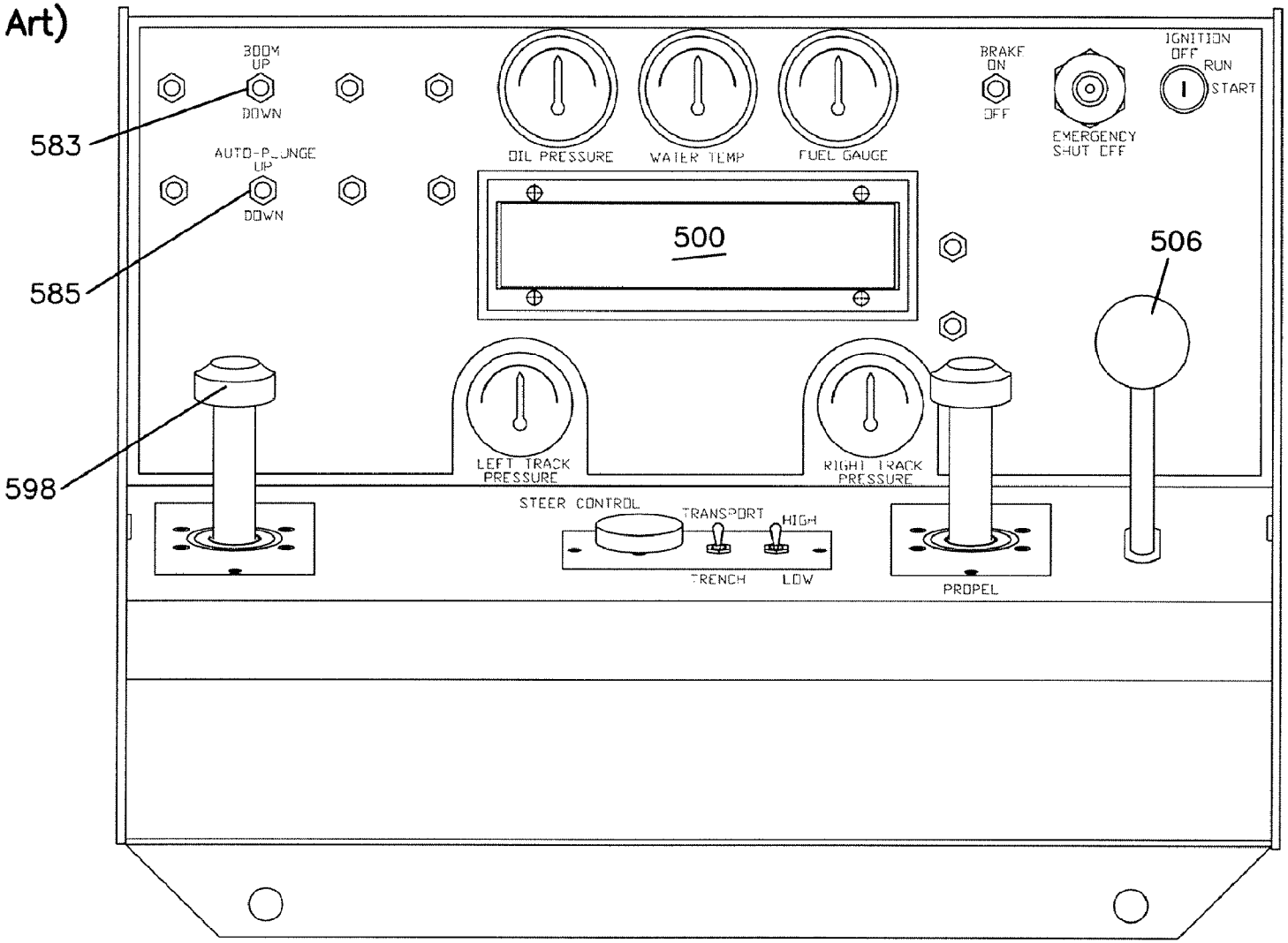
FIG.4 (Prior Art)
FIG. 4 is a full elevation view of a prior art track trencher control console incorporating an attachment speed control, an engine throttle, an attachment boom control, and a display.

In a preferred embodiment, the attachment 46 is coupled to the rear of the tractor portion 45 of the track trencher 30. Various attachments 46 are known in the art, each specialized to perform a specific type of excavating operation. FIG. 1 illustrates a type of attachment 46 employing the digging chain 50, and FIG. 3 illustrates a rock wheel 60 attachment 46. Other attachments 46, such as a TERRAIN LEVELER™, manufactured by Vermeer Manufacturing Company of Pella, Iowa, are also known in the art. The present invention is adaptable to the various attachments 46 described herein and others.

In accordance with the embodiment illustrated in FIGS. 7 through 9, the track trencher 30 is initially positioned at a desired excavation location, with the boom 47 raised to the above-ground position 37. A typical excavation effort involves two excavation operations. The first operation, termed a plunge-cut operation, involves cutting or otherwise removing earth between ground level (illustrated in FIG. 8) and a below-ground excavation level, indicated as a depth d in FIG. 9. A typical trench depth, d, ranges between approximately two feet to twenty feet for the track trencher 30 of the type illustrated in FIGS. 7 through 9. After completion of the plunge-cut operation with the boom 47 penetrating the earth to the desired excavation depth, d, the second excavation operation is optionally initiated, termed the trenching operation. A typical trenching procedure involves maintaining the boom 47 at the excavation depth, d, and propelling the tractor 45 and thereby the attachment 46 of the track trencher 30 in a desired direction, thereby cutting a trench from the initial plunge-cut location to a desired end of trench location.

Trenching excavation results when hydraulic power is applied to the attachment 46 and the track drives 32 and 34 while the track trencher 30 is in the below-ground position 39. Plunge-cut excavation results when hydraulic power is applied to the attachment 46 and to the boom cylinder 43 in the boom 47 lowering direction (see FIG. 17). Trenching and plunge-cutting can occur simultaneously resulting in a trench of increasing depth d. During trenching excavation, plunge-cutting excavation, or a combination of both, the hydraulic power induces movement on the active portion of the attachment 46, i.e. the digging chain 50 or the rock wheel 60. Optionally mounted to the active portion of the attachment 46 are excavation tools formed of a suitably hard material such as carbide teeth or other cutting implements. The hydraulic power provided to the track drives 32 and 34 and/or the boom cylinder 43 moves the active portion of the attachment 46 driving the subterranean portion of the attachment 46 into unexcavated soil. The active portion of the attachment 46 and tools mounted thereto engage and break up the soil and carry it away from the excavated area.

Performing a plunge-cut operation in soil having varying geophysical characteristics will produce concomitant variations in excavation difficulty as the activated digging chain 50 and the boom 47 are moved from the above-ground position 37, through the varying soil, to the excavation depth, d. In addition, plunge-cutting or trenching through soil with significant geophysical variations in adjacent layers can result in snagging and dislodging the harder layer which is poorly supported by the soft adjacent layer. The dislodged hard layer can jam into the cutting implements and cause the digging chain 50 and attachment 46 drive to stall.

The control system automatically responds, without requiring operator intervention, to the attachment 46 drive stall by lifting the boom 47 until the jam clears. Thereafter, the boom 47 is again lowered and plunge-cutting and/or trenching excavation resumes.

The control system and method modifies, without requiring operator intervention, actuation of the excavation implement 51 while excavating earth between the above-ground and below-ground positions so as to maintain the engine 36 powering the excavation implement 51 at a target operating level in response to variations in engine loading during the excavation operation. Likewise, the control system and method simultaneously modifies the actuation of the excavation implement 51 so as to maintain the attachment 46 drive at a target speed during excavation.

The control system and method obtains and thereafter maintains, without requiring operator intervention, the desired excavation depth d. In one embodiment, a desired boom (or boom cylinder) position 432 is selected by the operator. The computer network 182 compares the desired boom position 432 with the boom position signal 410 transduced by the boom position sensor 408. A difference between the desired position 432 and the boom position signal 410 results in sending a corrective boom valve down signal 414 or a corrective boom valve up signal 415 to the controllable valve 41. This results in movement of the boom 47 to a position nearer the desired position 432. This process is iteratively repeated until the desired position 432 is obtained. Thereafter, the process is iteratively repeated to maintain the desired position 432, accommodating disturbances that may be introduced to the system.

In a preferred embodiment of the present invention, various signals and settings are used by the control system to accomplish its various goals and functions. For the purposes of this disclosure, these control system variables can be generally classified into seven major categories. These categories may overlap each other and are introduced to organize this disclosure. These and other elements of the present invention could also be classified by other methods and the following classification method should not be interpreted as placing any limitation on the present invention.

In certain embodiments, certain of the various signals and settings 391, 392, 393, and 394 are stored in the non-volatile memory within the computer network 182 as illustrated in FIG. 12. Other signals and settings may be represented by an output value from a control lever or knob or a digital signal transmitted by a component such as the engine 36.

Figure 12A:
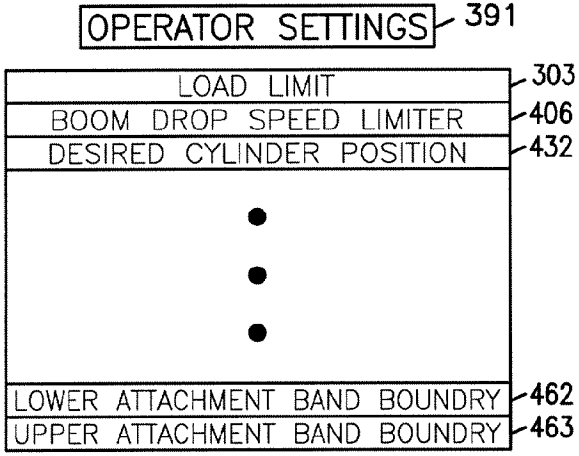
FIG. 12A is a block diagram illustrating an example list of variables relating to a plurality of operator settings used within the computer network of FIG. 12.
Figure 12B:
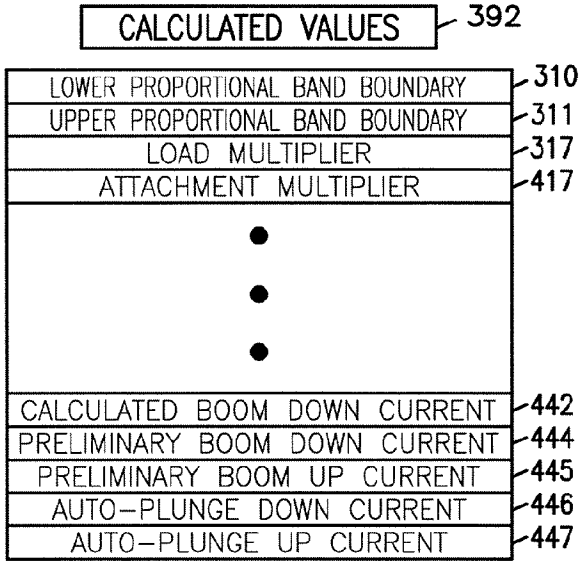
FIG. 12B is a block diagram illustrating an example list of variables relating to a plurality of calculated values calculated by and used within the computer network of FIG. 12.
Figure 12C:
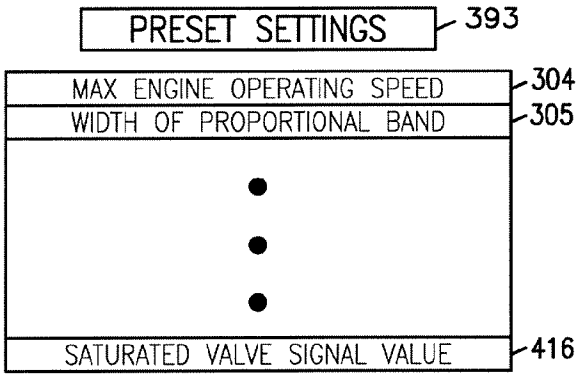
FIG. 12C is a block diagram illustrating an example list of variables relating to a plurality of preset settings used within the computer network of FIG. 12.

The first category of control system signals and settings includes a group of preset settings 393 that are preset at the control system's manufacture. Examples of these preset settings 393 are illustrated in FIG. 12C. These include a maximum engine operating speed 304 in revolutions-per-minute (RPM), a width 305 of a proportional band 330 in RPM, and a value 416 of a saturated valve command signal requesting maximum valve opening. Other embodiments of the present invention may allow for some or all of these values to be set and/or reset at other times.

Figure 12D:
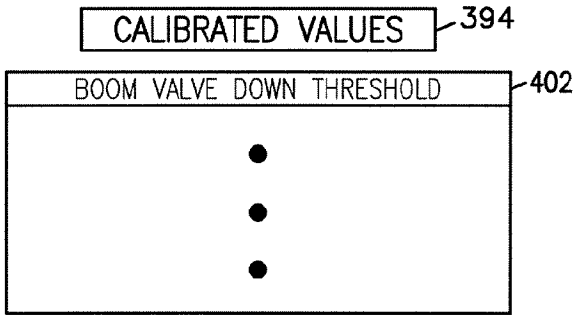
FIG. 12D is a block diagram illustrating an example list of variables relating to a plurality of calibrated values used within the computer network of FIG. 12.

The second category of signals and settings includes a group of calibrated values 394 derived during a calibration procedure. An example of these calibrated values 394 is illustrated in FIG. 12D. This includes a threshold boom down output signal value 402 for the controllable valve 41. The calibration method to determine this value simply increases the boom down valve control signal 414 to the controllable valve 41 until the cylinder rod 53 of the boom hydraulic cylinder 43 moves. The control signal 414 value which initiated movement is then recorded as the threshold boom down value 402 and stored in the computer network 182. In certain embodiments of the present invention, the controllable valve 41 may be pre-calibrated or may not require calibration.

Figure 5:
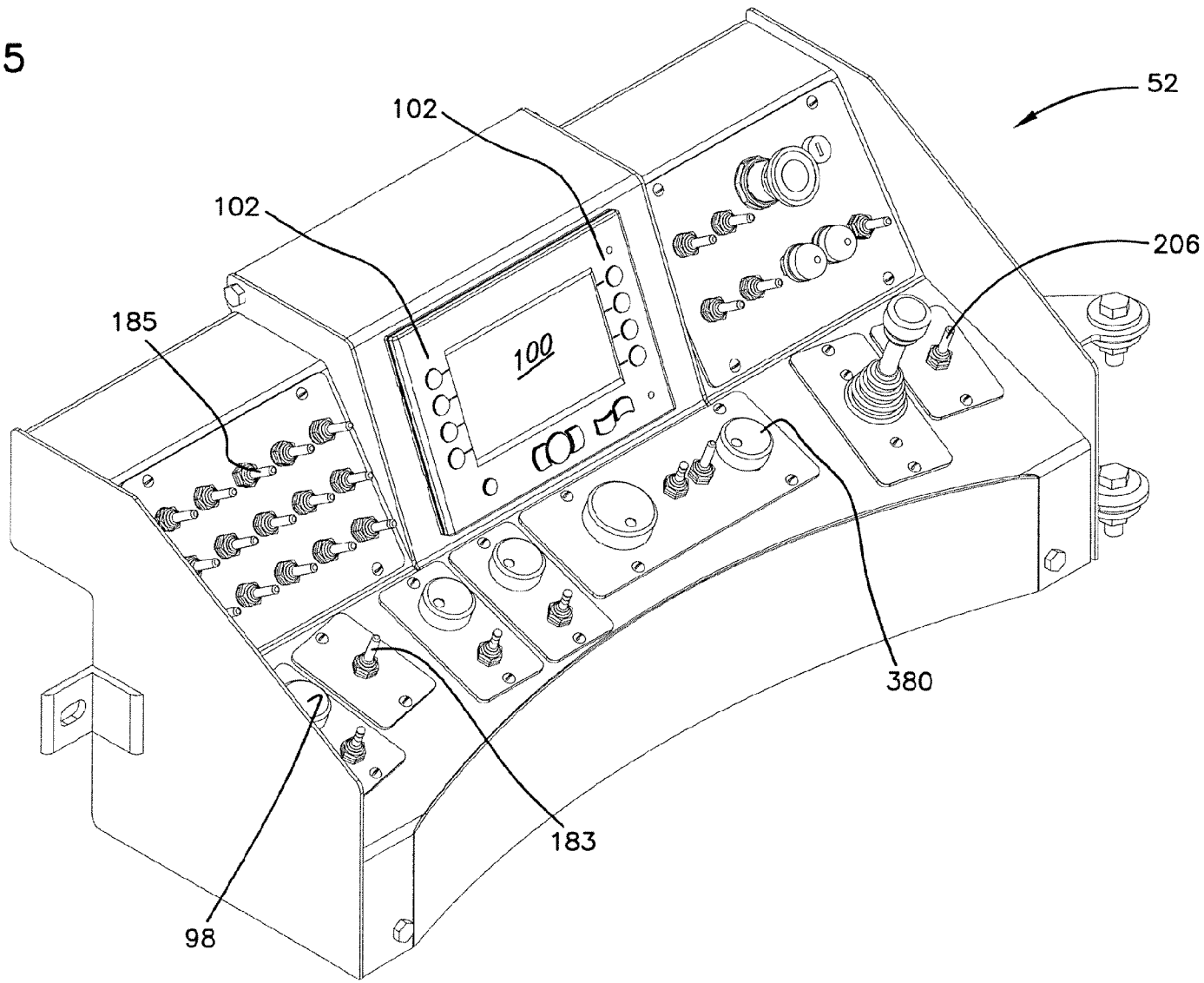
FIG. 5 is a full perspective view of a track trencher control console incorporating a load control knob, an engine throttle, an attachment speed control, a manual boom control, an auto-plunge enable switch, and a display with a plurality of menu navigation and selection buttons.
Figure 6:
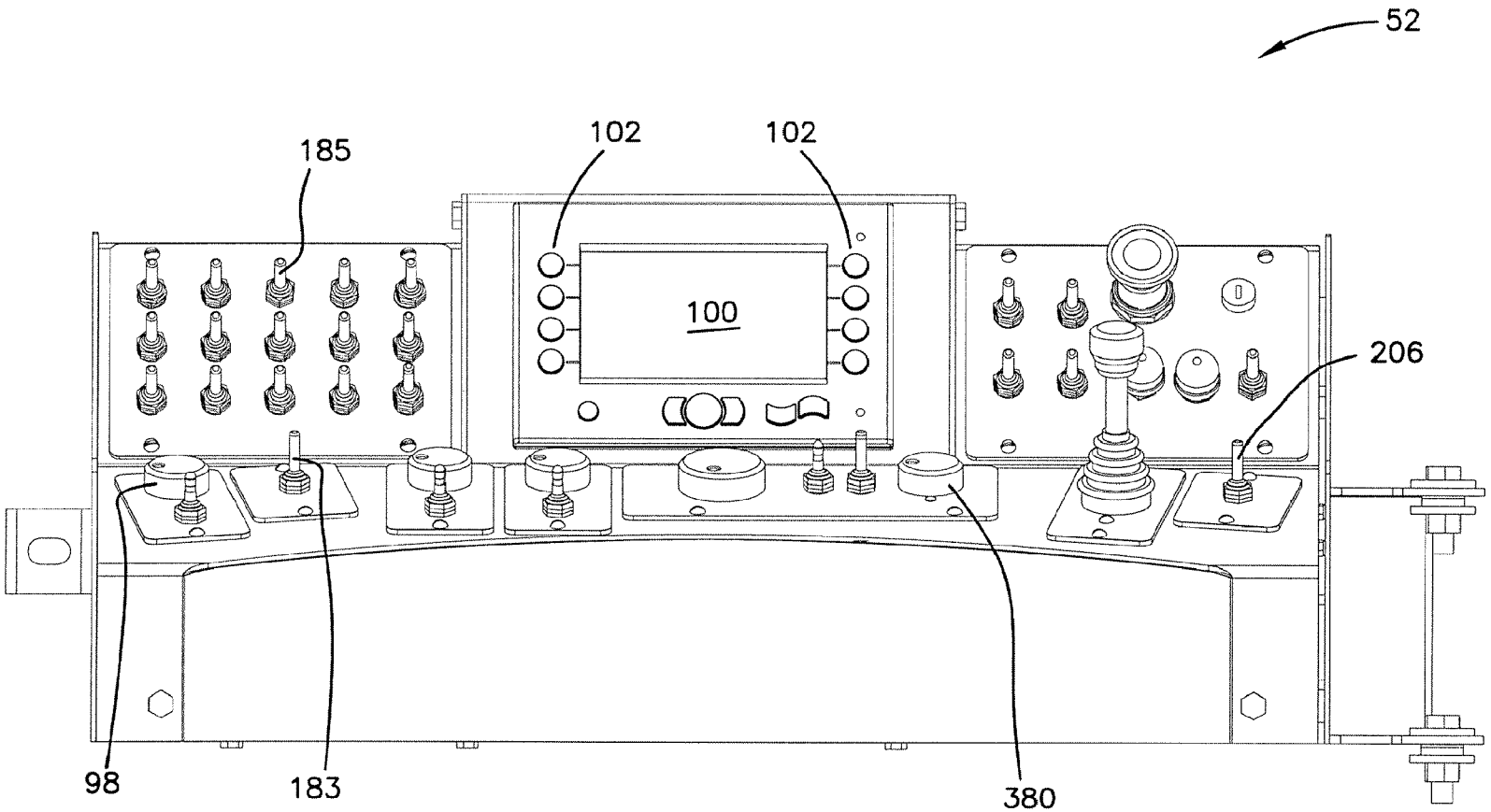
FIG. 6 is a full elevation view of the control console of FIG. 5.

The third category of signals and settings includes a group of operator settings 391 set by the operator on an occasional basis, typically by accessing a control on an operator's control console 52 (see FIGS. 5 and 6). Examples of these operator settings 391 are illustrated in FIG. 12A. Additional examples include an engine throttle 206 setting, an attachment speed control setting 98, an auto-plunge enable setting 185, and a load control signal 308 in percent. The load control signal 308 is preferably generated by a load control knob 380 which produces a signal of 0% when rotated fully counterclockwise, 100% when rotated fully clockwise and proportional values when between these extremes. An operator display 100 and software menu navigation and selection buttons 102 provide access to view and edit various control system menu settings. Alternatively, the display 100 could be touchscreen and/or computer mouse navigated. In a preferred embodiment, the settings editable via the display 100 include a load limit control setting 303 in RPM, a boom drop speed limiter value 406 in percent, the desired boom (or boom cylinder) position 432 in percent, an attachment drive speed proportional band lower boundary 462, and an attachment drive speed proportional band upper boundary 463. Various other accessory controls are optionally located on the operator's control console 52. Certain operators and certain trenching and plunge-cutting techniques may use one or more of these settings on a continuous basis. In certain embodiments, some of these settings may be preset at the control system's manufacture and may not be modifiable by the operator.

The fourth category of signals and settings includes those settings adjusted by the operator on a more frequent or continuous basis, typically by accessing a control on the operator's control console 52 (see FIGS. 5 and 6). An example of this includes a manual boom control switch 183 for operating the boom 47 position manually.

The fifth category of signals and settings includes those signals that indicate a measured physical trencher 30 or environmental condition and/or a trencher 30 response to the control system and environment. Examples of these include an engine speed signal 312 in RPM generated by an engine speed sensor 208, the attachment drive speed signal 324 in RPM generated by the attachment drive speed sensor 186, the attachment hydrostatic drive pressure 323, the boom (or boom cylinder) position signal 410 in percent, and various system and environmental temperatures.

The sixth category of signals and settings includes a group of calculated values 392 calculated by the control system computer network 182 for further use by the control system. Examples of these calculated values 392 are illustrated in FIG. 12B. These include a load multiplier 317, a lower boundary of the load multiplier/engine speed proportional band 310, an upper boundary of the load multiplier/engine speed proportional band 311, an attachment multiplier 417, a calculated boom down current 442, a preliminary boom down current 444, a preliminary boom up current 445, an auto-plunge down current 446, and an auto-plunge up current 447.

A seventh category of signals and settings include those signals derived by the control system for control of a system parameter. Examples of these signals include the boom down valve control signal 414, the boom up valve control signal 415, and the attachment drive pump signal 322.

The control system input signals and settings described above may be generated by an operator selection of a discrete physical switch setting (e.g., the auto-plunge enable setting 185), an operator selection of a continuous physical control setting (e.g., the desired boom position 432), or an operator selection of a discrete or continuous setting via the operator display 100 and menu buttons 102 (e.g. the load limit control setting 303). The method of accessing and changing these setting as described above may be reconfigured between physical and virtual control system access points without departing from the true spirit of the present invention.

Referring now to the figures to facilitate an in-depth discussion, and more particularly to FIGS. 5 through 24, there is shown an auto-plunge and boom depth control system for use with a track trencher 30.

As discussed above, FIGS. 5 and 6 illustrate one embodiment of the operator's control console 52 with a plurality of physical and virtual access points which allow the operator to automatically or manually control the various functions associated with plunge-cutting and boom depth control.

FIGS. 7 through 9 illustrate one embodiment of the kinematic layout and connections of the boom 47, the tractor 45, and the boom actuating hydraulic cylinder 43 as the boom 47 is moved through its range of motion. FIGS. 10 and 11 further illustrate the boom actuating hydraulic cylinder 43 having a retracted length, R, and an extended length, R+E. In a preferred embodiment, the boom cylinder position sensor 408 is coupled to the hydraulic cylinder 43 by the coupler 409 such that any extension or retraction of the cylinder rod 53 produces a corresponding extension or retraction of the sensor 408. In a preferred embodiment, the sensor 408 is a Hall Effect sensor which produces an electrical signal proportional to the extension of the sensor 408.

FIG. 12 illustrates one embodiment of the various signals transmitted and received by the computer network and their connection to the various components of the track trencher 30. In addition, several mechanical and hydraulic connections are illustrated between the various components.

Figure 13:
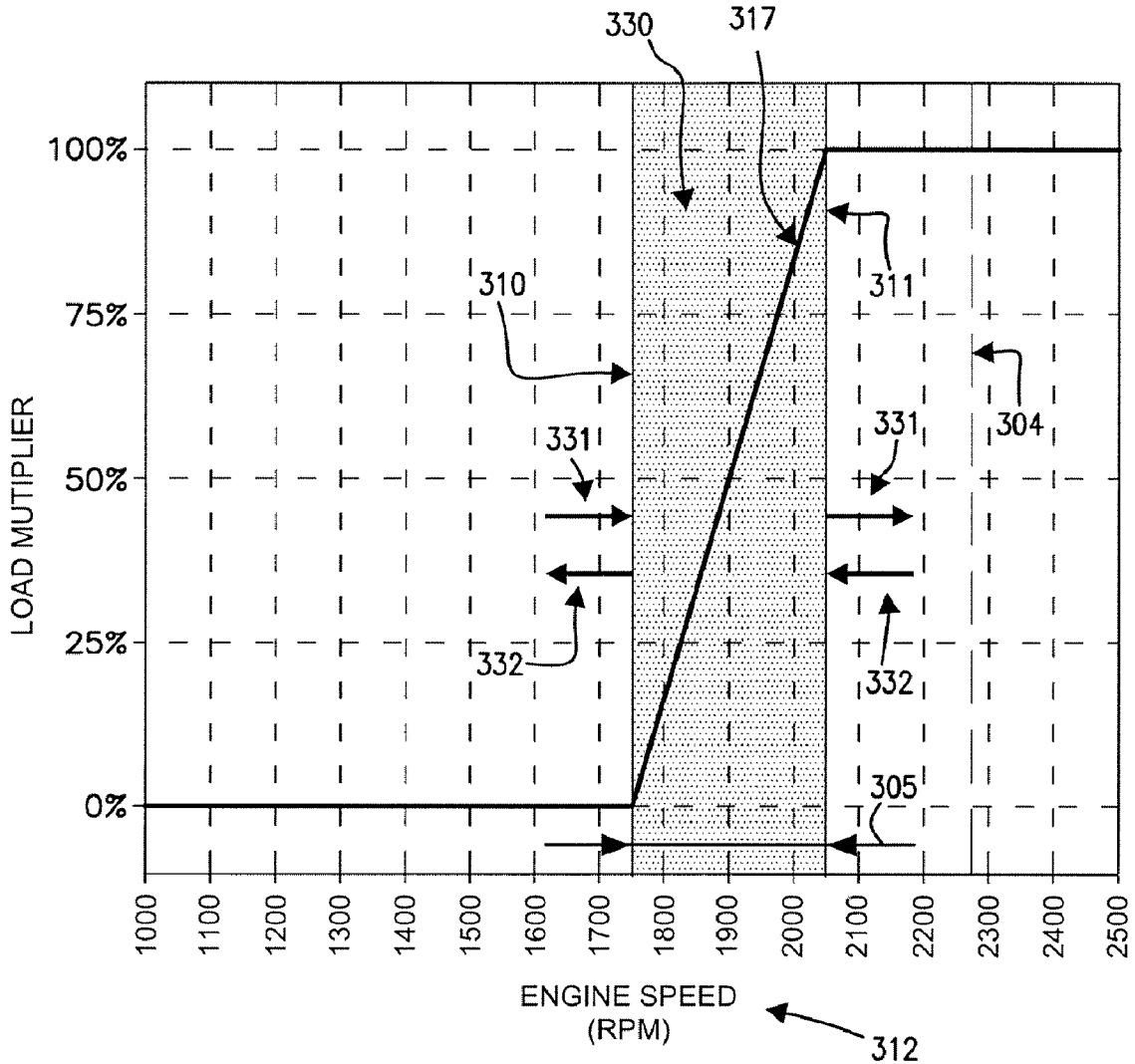
FIG. 13 graphs a load multiplier vs. an engine speed at a particular setting and illustrates a modifiable load multiplier/engine speed proportional band with an upper boundary and a lower boundary.
Figure 14:
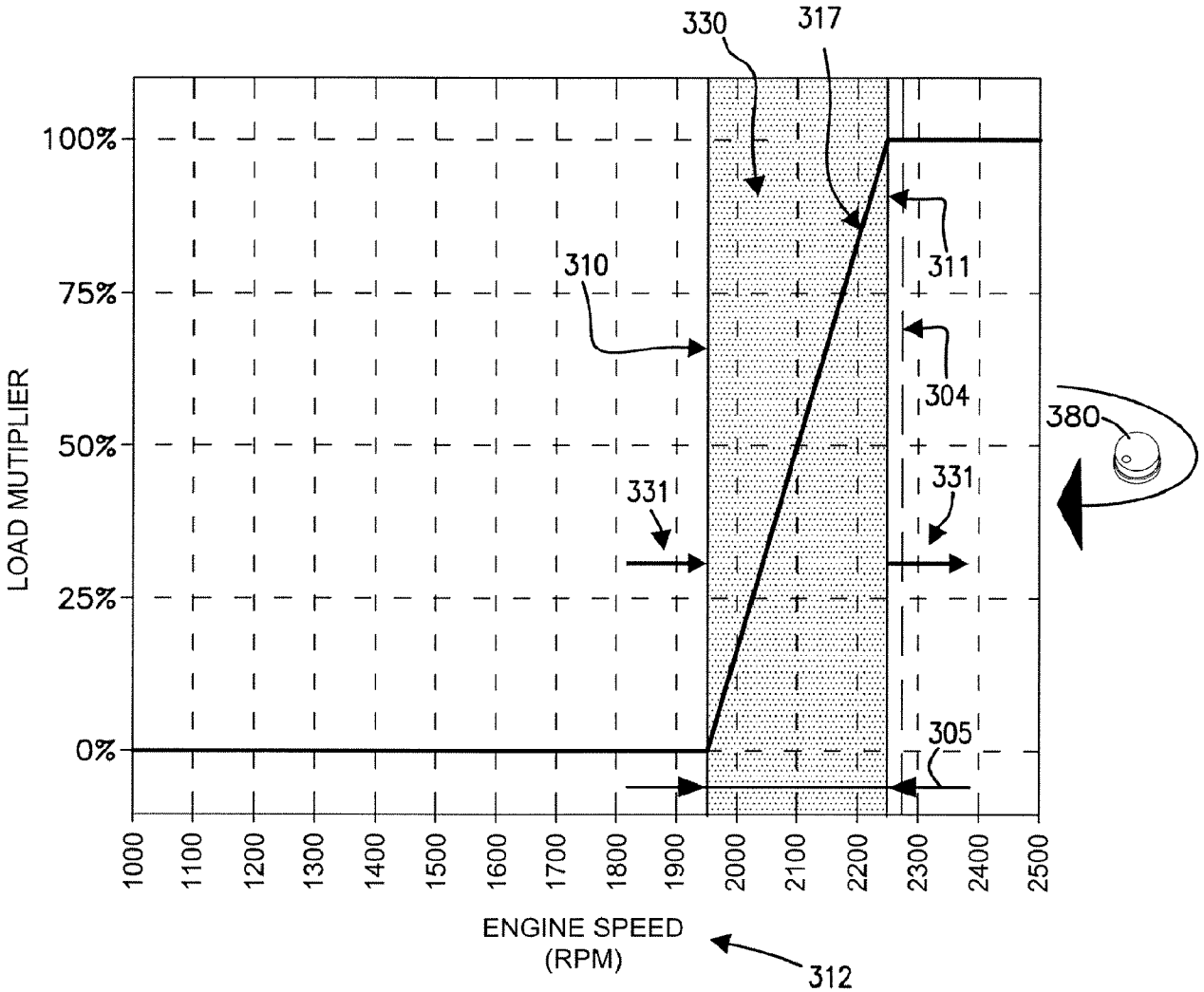
FIG. 14 illustrates the modifiable proportional band and graph of FIG. 13 where the location of the band has been increased by turning the load control knob clockwise.
Figure 15:
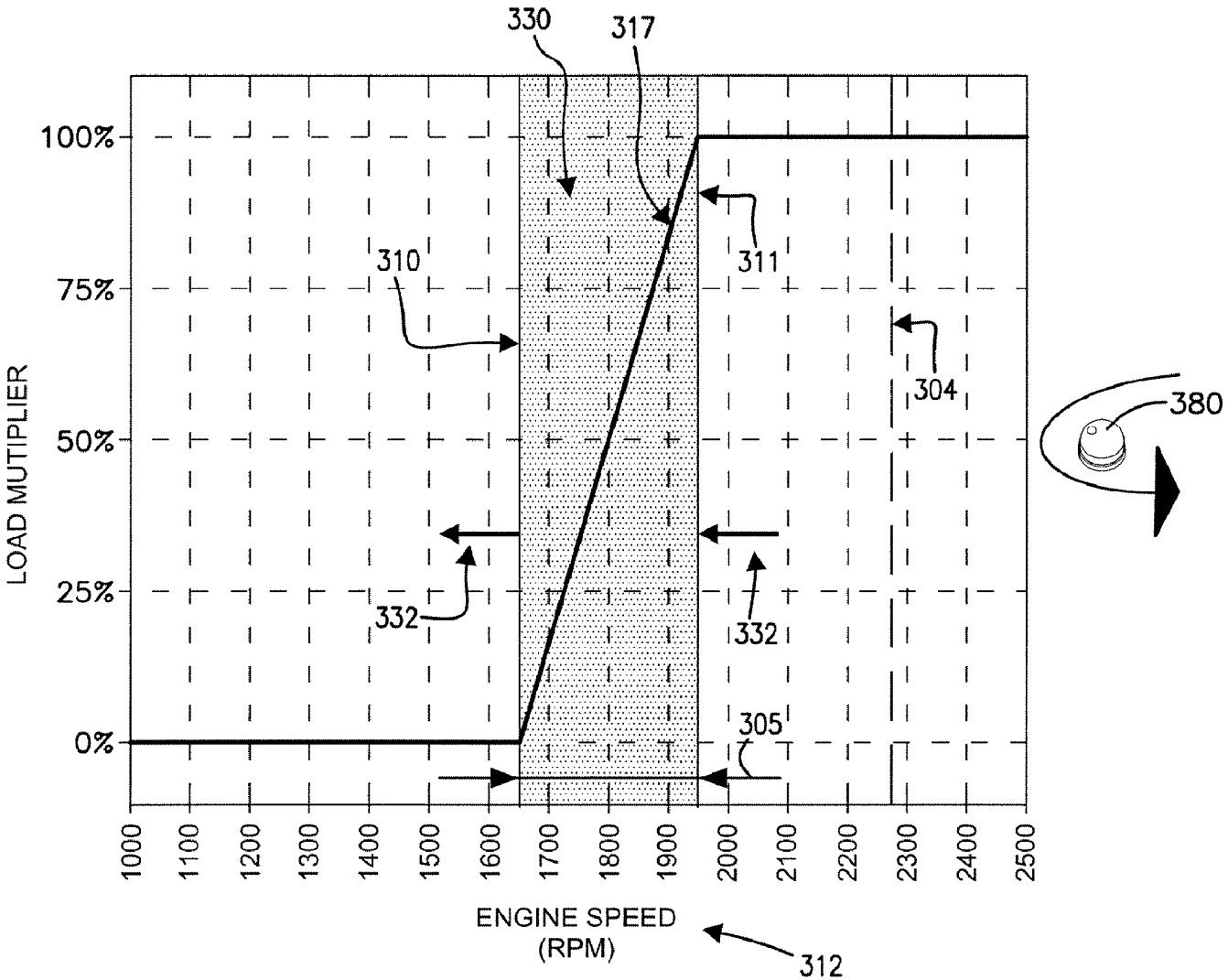
FIG. 15 illustrates the modifiable proportional band and graph of FIG. 13 where the location of the band has been decreased by turning the load control knob counter-clockwise.

FIGS. 13 through 15 illustrate a modifiable proportional band 330 wherein the relationship between the engine speed 312 and the load multiplier 317 is proportional. The operator may choose and later modify the location of the proportional band 330 by either increasing 331 or decreasing 332 it by use of the load control knob 380. As illustrated in FIG. 14, a clockwise movement of the load control knob 380 increases 331 the position of the proportional band 330. Conversely, a counter-clockwise movement of the load control knob 380 decreases 332 the position as illustrated in FIG. 15. The specific location of the load control knob 380 may be set according to operator preference and/or the current trenching/plunge-cutting environment. The proportional band 330 and load multiplier 317, as shown in FIGS. 13 through 15 and calculated in FIGS. 18 and 19 describe a linear proportional relationship. In other embodiments of the present invention, other non-linear functional relationships may be utilized and other elements, such as integral and derivative terms may be included.

Figure 16:
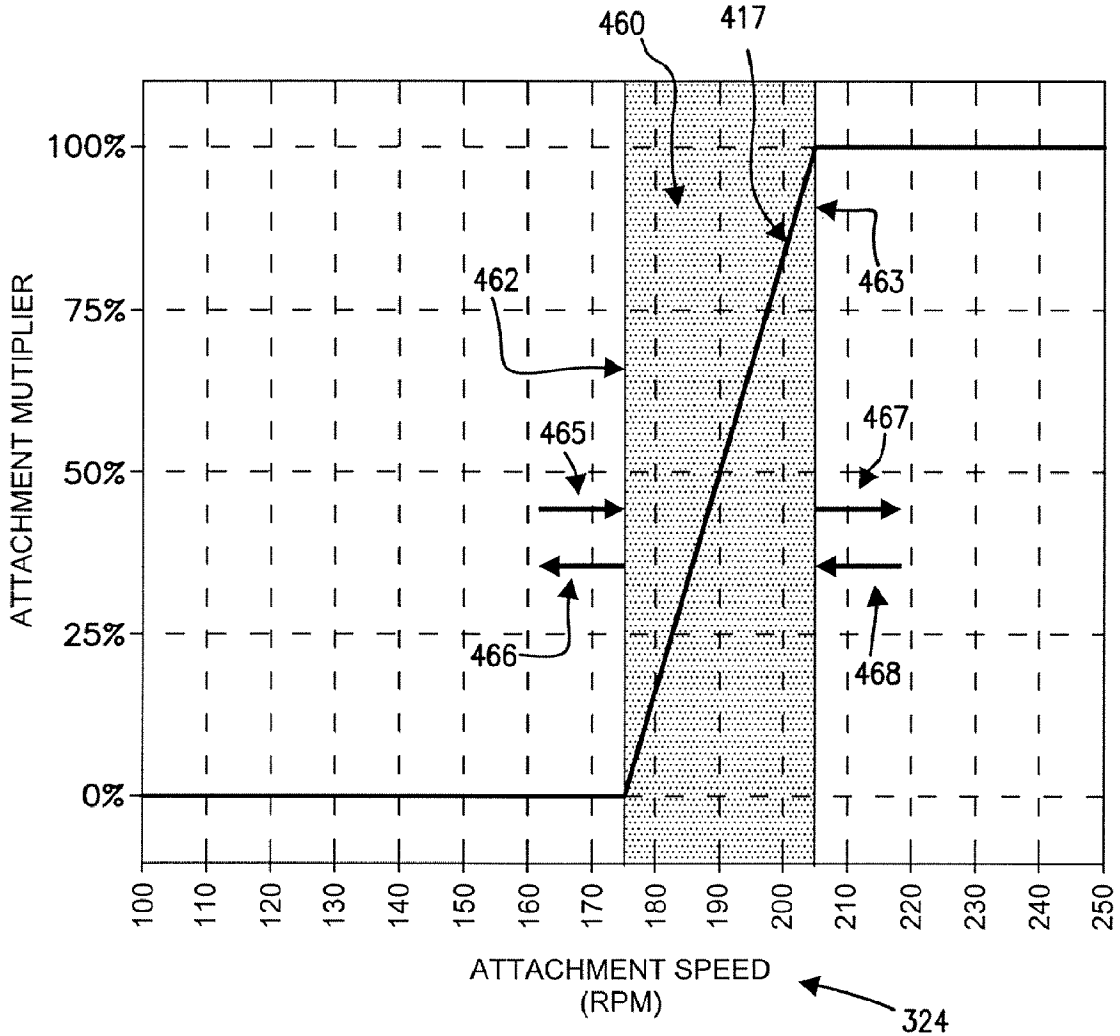
FIG. 16 graphs an attachment multiplier vs. an attachment drive speed at a particular setting and illustrates a modifiable attachment multiplier/attachment speed proportional band with an upper boundary and a lower boundary.

FIG. 16 illustrates a modifiable proportional band 460 wherein the relationship between the attachment drive speed 324 and the attachment multiplier 417 is proportional. The operator may choose and later modify the location of the upper boundary 463 of the proportional band 460 by either increasing 467 or decreasing 468 it. Likewise, the operator may choose and later modify the location of the lower boundary 462 of the proportional band 460 by either increasing 465 or decreasing 466 it. Increasing 467 and 465 and decreasing 468 and 466 the boundaries 463 and 462 may be accomplished by using the operator display 100 and software menu navigation and selection buttons 102 on the operator's control console 52. The proportional band 460 and attachment multiplier 417, as shown in FIG. 16 and calculated in FIG. 20 describe a linear proportional relationship. In other embodiments of the present invention, other non-linear functional relationships may be utilized and other elements, such as damping may be included.

FIG. 17 is a simplified schematic diagram illustrating a relationship between the computer network 182, the controllable valve 41, the boom hydraulic cylinder 43, the boom cylinder position sensor 408, a hydraulic supply pump 55, and a hydraulic tank 57. As mentioned above, the computer network 182 compares the actual boom cylinder 43 position, represented by the boom cylinder position signal 410, to the desired boom cylinder position 432 (see FIG. 12). If extending the boom cylinder 43 position is desired, the boom down valve control signal 414, as calculated in FIGS. 18 through 24, is transmitted to the controllable valve 41, shifting the spool to the left and causing the supply pump 55 pressure to be sent along hydraulic line 59 to the cylinder 43. This, in turn, causes the cylinder rod 53 to extend and return hydraulic fluid to be sent to the tank 57 along hydraulic line 61. If retracting the boom cylinder 43 position is desired, the boom up valve control signal 415, as calculated in FIGS. 18 through 24, is transmitted to the controllable valve 41, shifting the spool to the right and causing the supply pump 55 pressure to be sent along hydraulic line 61 to the cylinder 43. This, in turn, causes the cylinder rod 53 to retract and return hydraulic fluid to be sent to the tank 57 along hydraulic line 59. If no change in the boom cylinder 43 position is desired, no signal is sent to the controllable valve 41 and the spool remains centered blocking hydraulic lines 59 an 61. This, in turn, causes the cylinder rod 53 to remain fixed. Other embodiments of the present invention may substitute other valving having different details but producing similar results.

FIGS. 18 through 24 describe an embodiment of the present invention in the context of flowcharts which calculate and manipulate various control system variables to control the boom 47 position in both automatic and manual modes. It is anticipated that other algorithms can be devised that result in equivalent relationships between the various variables.

Figure 18:
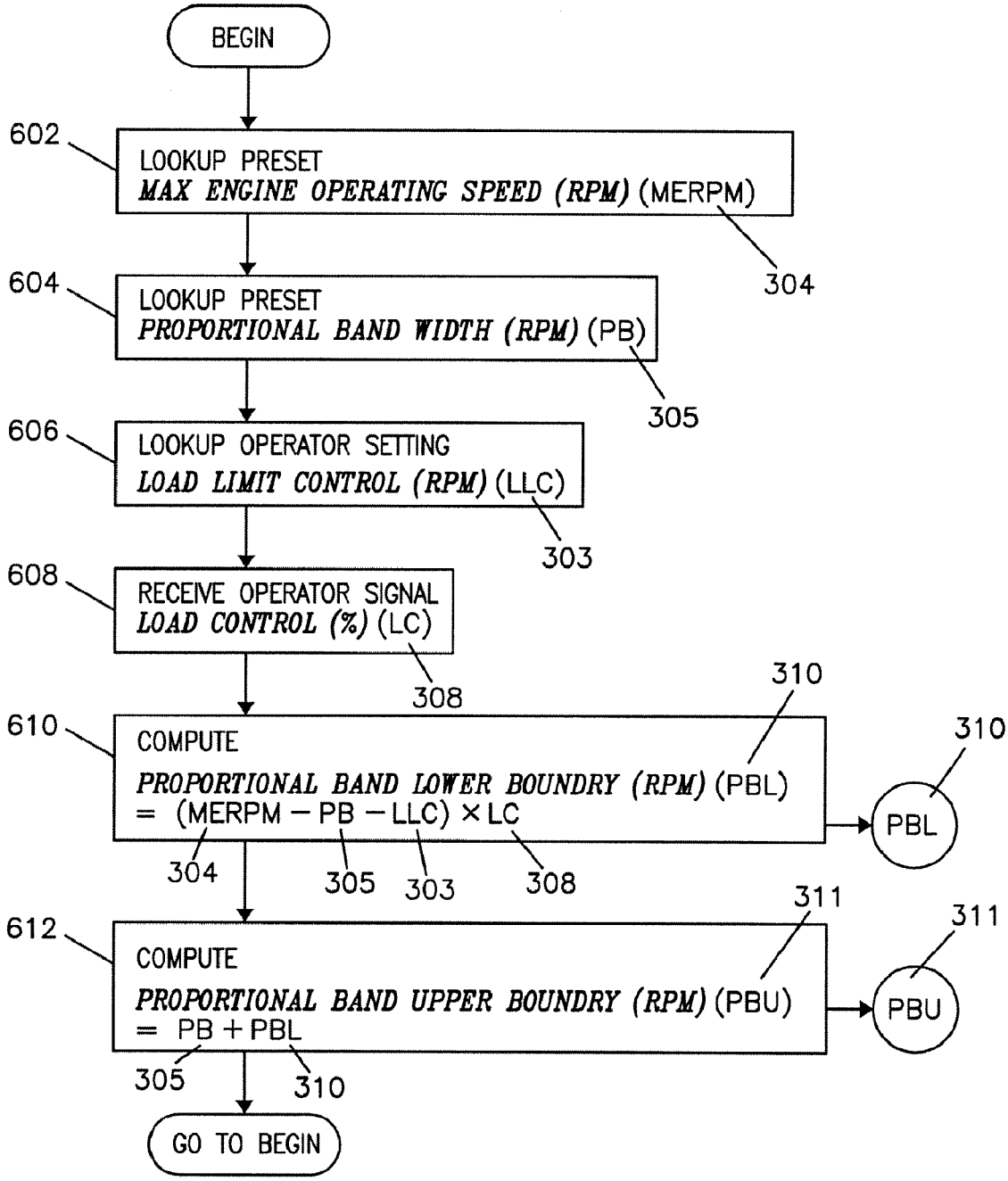
FIG. 18 illustrates a control process for calculating the boundaries of the load multiplier/engine speed proportional band of FIGS. 13 through 15 given current input parameters.

FIG. 18 illustrates a method by which the upper boundary 311 and lower boundary 310 of the proportional band 330 are calculated and stored. Inputs for this method are retrieved in steps 602 through 608 and include the maximum engine operating speed 304 in step 602, the width of the proportional band 305 in step 604, the load limit control setting 303 in step 606, and the load control setting 308 in step 608. The lower boundary 310 is calculated as shown in step 610 and stored and the upper boundary 311 is calculated as shown in step 612 and stored. The calculation cycle is then repeated.

Figure 19:
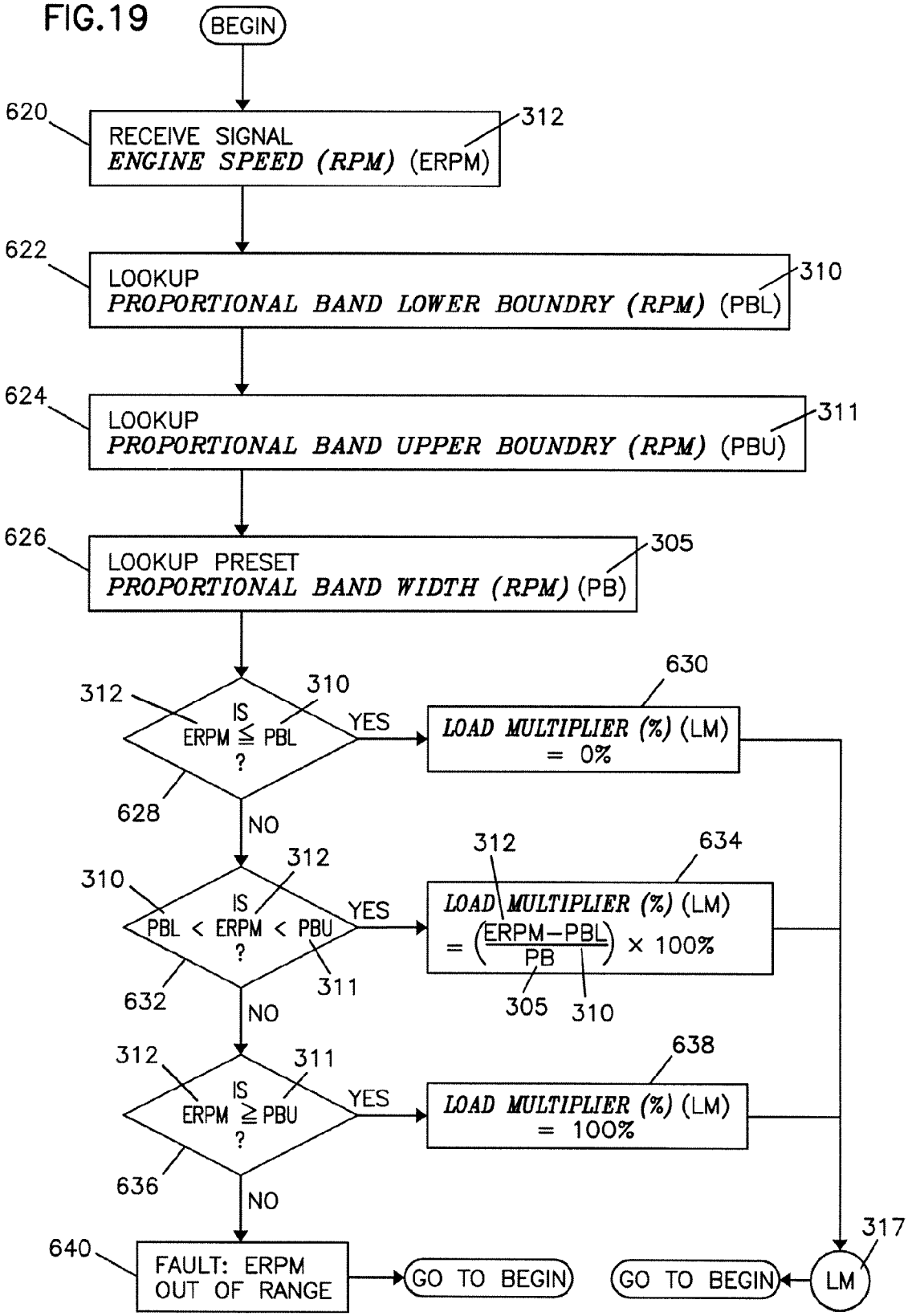
FIG. 19 illustrates a control process for calculating the load multiplier of FIGS. 13 through 15 given current input parameters.

FIG. 19 illustrates a method by which the load multiplier 317 is calculated and stored. Inputs for this method are retrieved in steps 620 through 626 and include the actual engine speed 312 in step 620, the lower boundary 310 in step 622 and upper boundary 311 in step 624 of the proportional band 330, and the width of the proportional band 305 in step 626. The engine speed 312 is tested in step 628 and if found to be less than or equal to the lower boundary 310, then the load multiplier 317 is set to 0% in step 630 and stored. If the result of step 628 is no, the engine speed 312 is tested in step 632. If the engine speed 312 is found to be within the upper boundary 311 and the lower boundary 310, then the load multiplier 317 is calculated as shown in step 634 and stored. If the result of step 632 is no, the engine speed 312 is tested in step 636. If the engine speed 312 is found to be greater than or equal to the upper boundary 311, then the load multiplier 317 is set to 100% in step 638 and stored. If the result of step 636 is no, then an out of range fault is generated in step 640. The calculation cycle is repeated after the load multiplier 317 is stored or after step 640.

Figure 20:
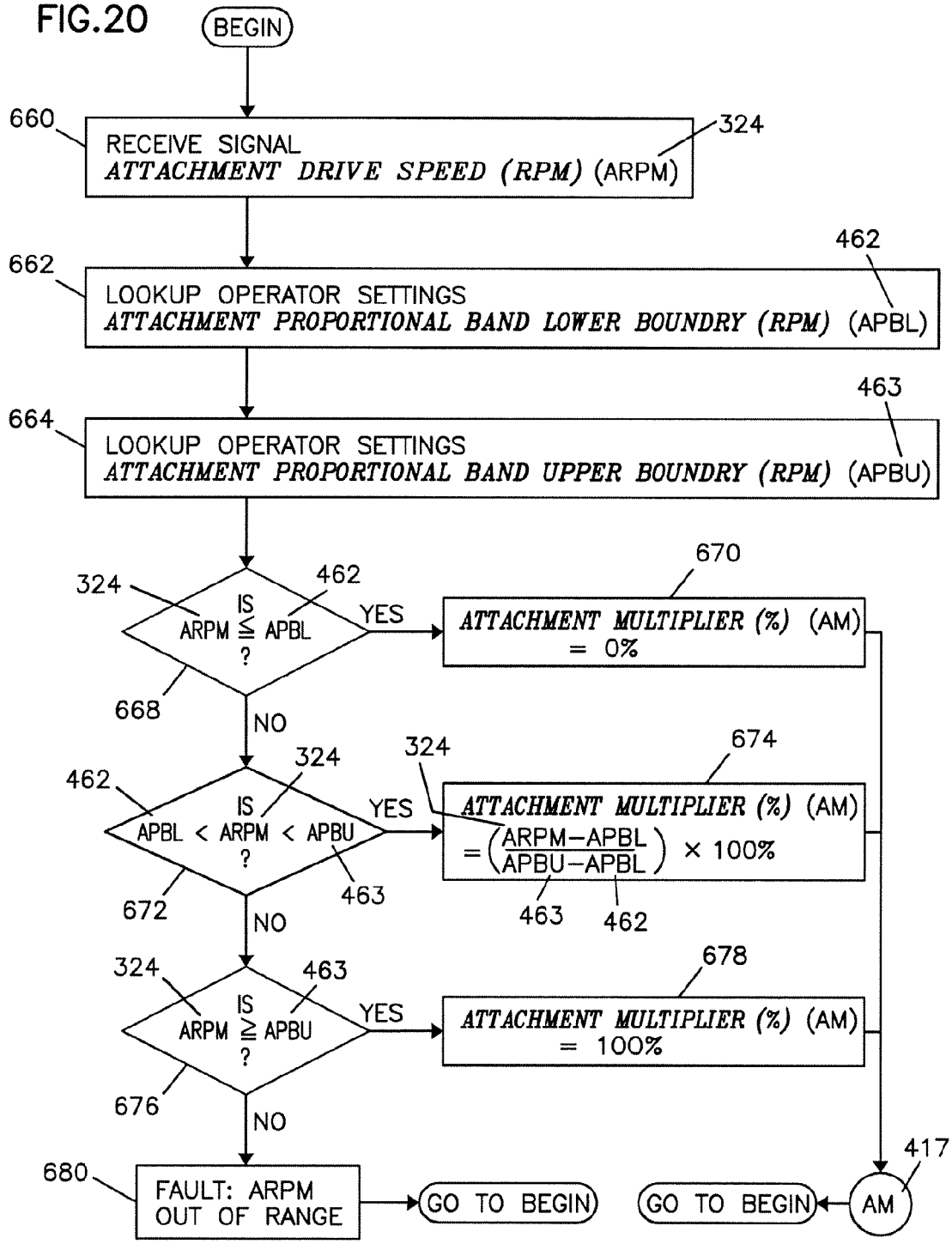
FIG. 20 illustrates a control process for calculating the attachment multiplier of FIG. 16 given current input parameters.

FIG. 20 illustrates a method by which the attachment multiplier 417 is calculated and stored. Inputs for this method are retrieved in steps 660 through 664 and include the attachment drive speed 324 in step 660 and the lower boundary 462 in step 662 and the upper boundary 463 in step 664 of the attachment speed proportional band 460. The attachment drive speed 324 is tested in step 668 and if found to be less than or equal to the lower boundary 462, then the attachment multiplier 417 is set to 0% in step 670 and stored. If the result of step 668 is no, the attachment drive speed 324 is tested in step 672. If the attachment drive speed 324 is found to be within the upper boundary 463 and the lower boundary 462, then the attachment multiplier 417 is calculated as shown in step 674 and stored. If the result of step 672 is no, the attachment drive speed 324 is tested in step 676. If the attachment drive speed 324 is found to be greater than or equal to the upper boundary 463, then the attachment multiplier 417 is set to 100% in step 678 and stored. If the result of step 676 is no, then an out of range fault is generated in step 680. The calculation cycle is repeated after the attachment multiplier 417 is stored or after step 680.

Figure 21:
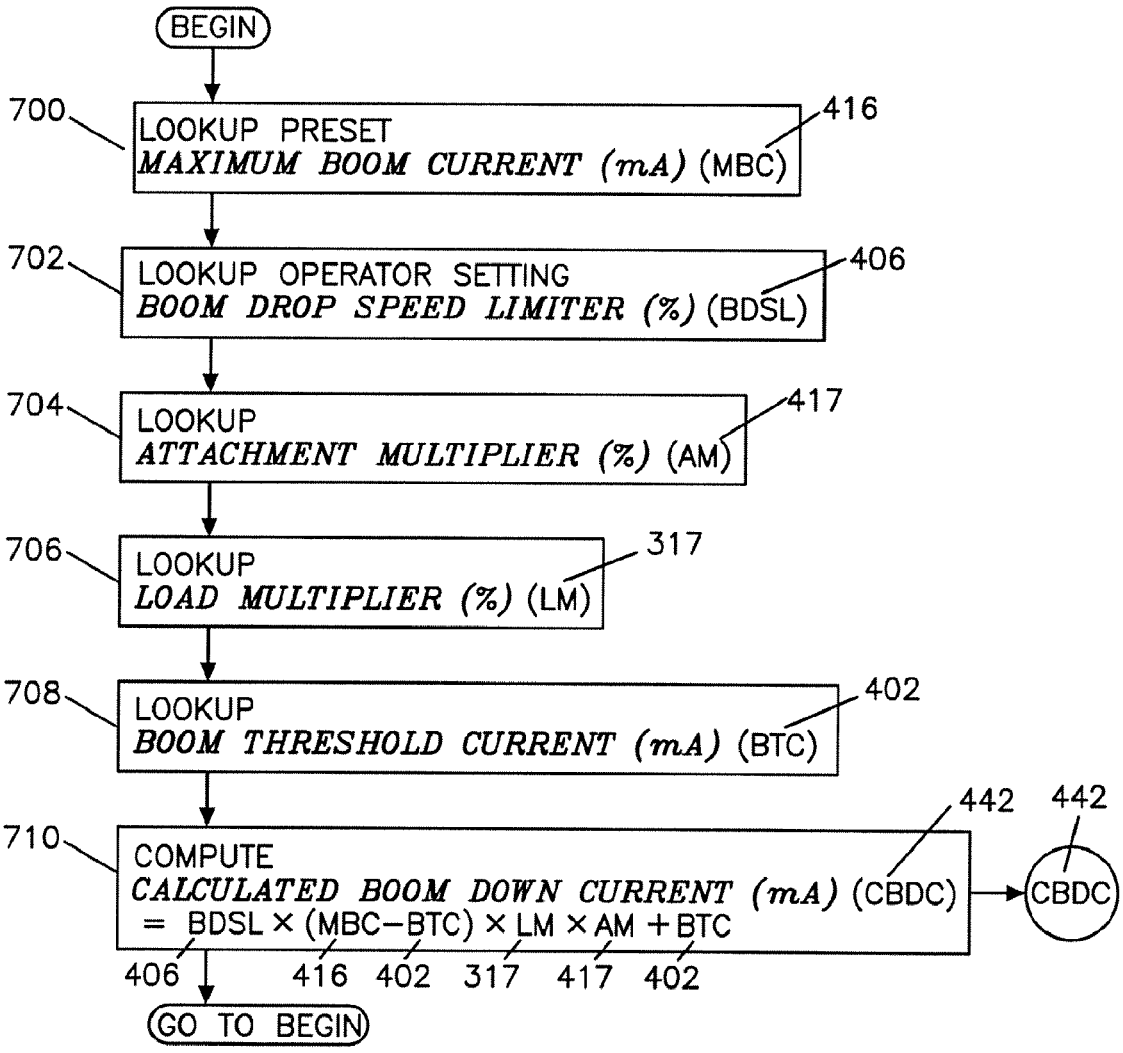
FIG. 21 illustrates a control process for calculating a calculated boom down current given current input parameters.
Figure 22:
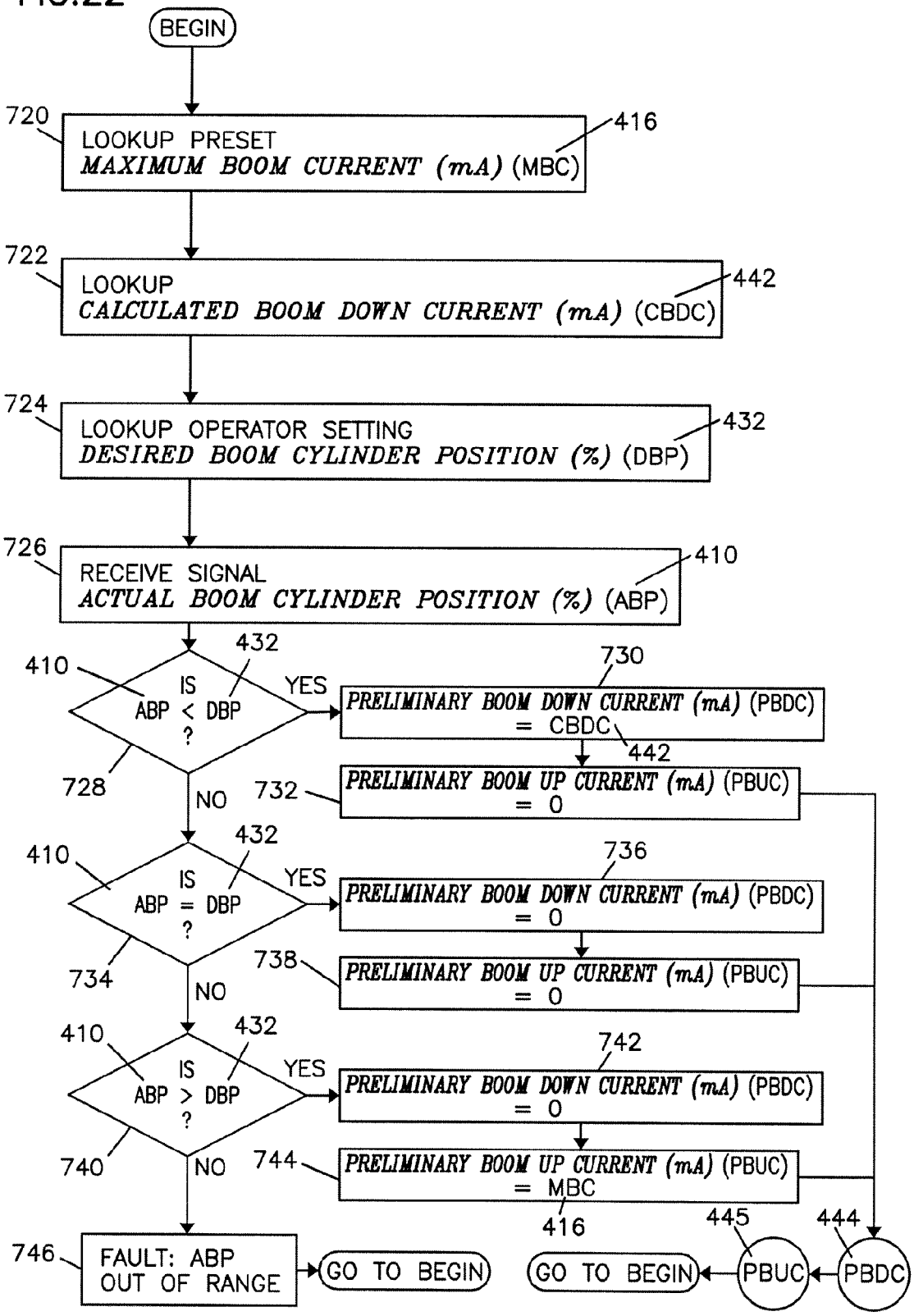
FIG. 22 illustrates a control process for calculating a preliminary boom down current and a preliminary boom up current given current input parameters.
Figure 23:
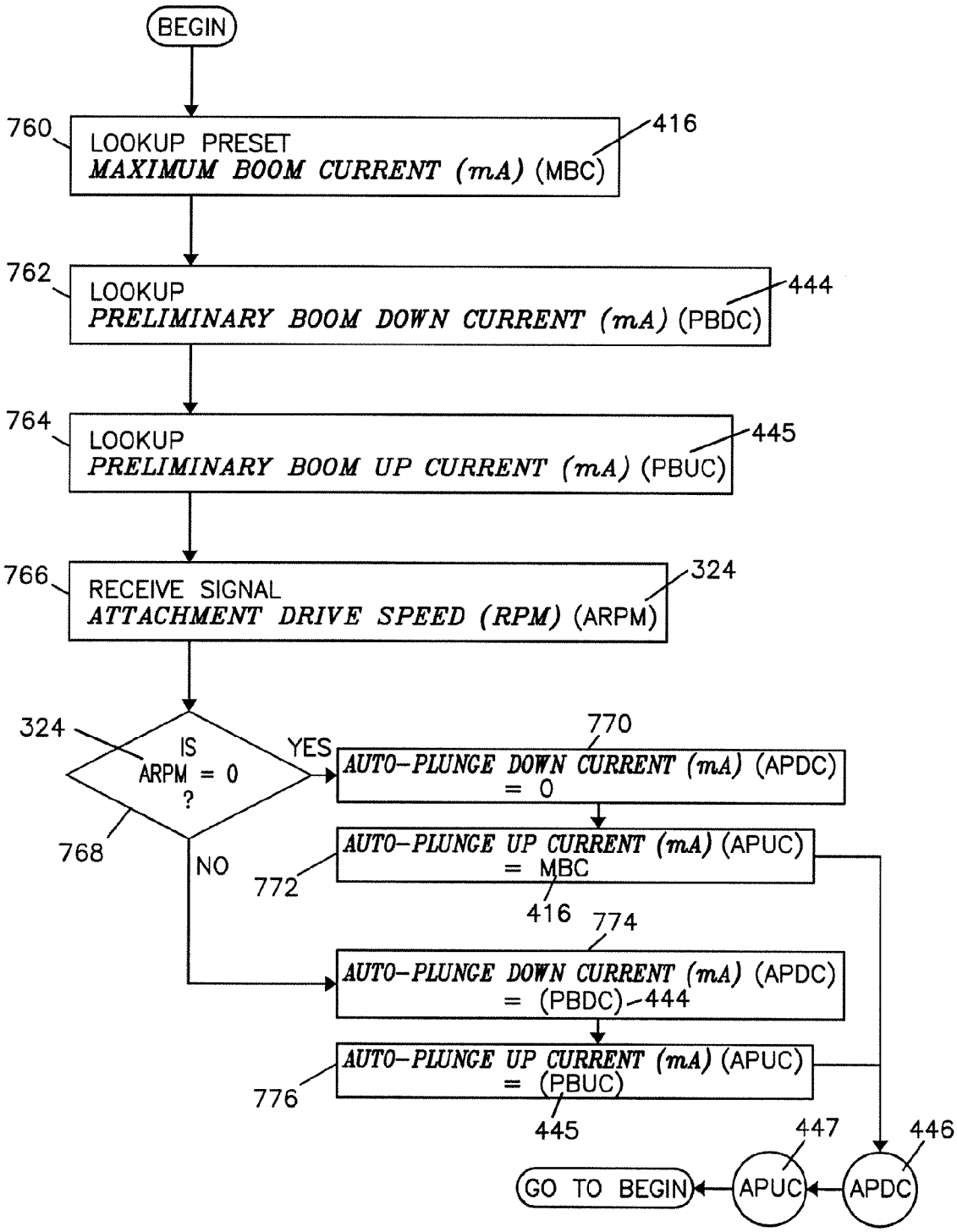
FIG. 23 illustrates a control process for calculating an auto-plunge down current and an auto-plunge up current given current input parameters.
Figure 24:
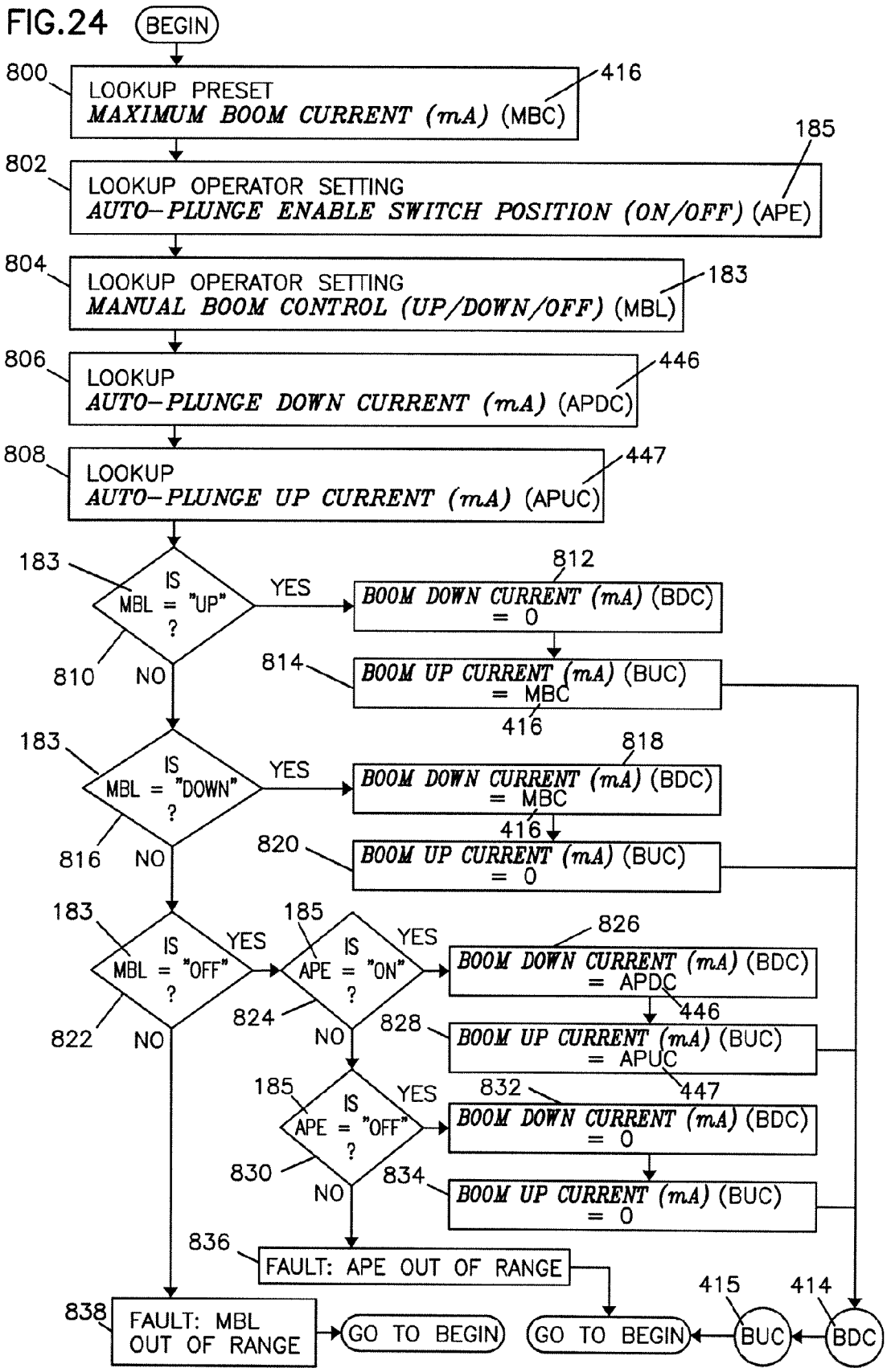
FIG. 24 illustrates a control process for calculating a boom down current and a boom up current given current input parameters.

A feature in certain embodiments of the present invention concerns the load multiplier 317 and the associated operator modifiable proportional band 330 shown in FIGS. 13 through 15 and calculated in FIGS. 18 and 19. The load multiplier 317 provides engine 36 feedback to the control system and is used to calculate the calculated boom down current 442 as shown in FIG. 21. In addition, a feature in certain embodiments of the present invention concerns the attachment multiplier 417 and the associated operator modifiable proportional band 460 shown in FIG. 16 and calculated in FIG. 20. The attachment multiplier 417 provides attachment drive speed 324 feedback to the control system and is also used to calculate the calculated boom down current 442 as shown in FIG. 21. The calculated boom down current 442 is further used as the preliminary boom down current 444 if certain tests are met as shown in FIG. 22. The preliminary boom down current 444 is further used as the auto-plunge down current 446 if certain tests are met as shown in FIG. 23. The auto-plunge down current 446 is further used as the boom down current 414 and sent to the controllable valve 41 if certain tests are met as shown in FIG. 24.

The load multiplier 317 and proportional band 330 provide a benefit of continuously adjusting the calculated boom down current 442 based on engine load. This allows the engine 36 to continuously operate at high output levels and thus the track trencher 30 obtains high production levels. In other terms, if compacted soil is encountered by the track trencher 30 such that the engine speed 312 is pulled down during a plunge-cutting operation, the load multiplier 317 is decreased which also results in a reduction of the calculated boom down current 442. In the case that the calculated boom down current 442 also becomes the boom down current 414 (as described in the preceding paragraph), the controllable valve 41 decreases the rate of boom 47 plunging and thus relieves some of the load on the engine 36 and allows the engine speed 312 to increase. Conversely, if loose soil is encountered such that the engine speed 312 increases, the load multiplier 317 is increased. This correspondingly results in an increase in the rate of boom 47 plunging. This action increases the load on the engine 36 and decreases the engine speed 312. By proper adjustment of the control system variables, the engine speed 312 can be maintained in a region of high output and the rate of boom 47 plunging can be continuously and automatically adjusted for this purpose.

The attachment multiplier 417 and proportional band 460 provide a benefit of continuously adjusting the calculated boom down current 442 based on the attachment drive speed 324. This allows the attachment drive speed 324 to continuously operate near a target speed. In other terms, if compacted soil is encountered by the track trencher 30 such that the attachment drive speed 324 is pulled down during a plunge-cutting operation, the attachment multiplier 417 is decreased which also results in a reduction of the calculated boom down current 442. In the case that the calculated boom down current 442 also becomes the boom down current 414 (as described in the preceding two paragraphs), the controllable valve 41 decreases the rate of boom 47 plunging and thus relieves some of the attachment motor 48 load and allows the attachment drive speed 324 to increase. Conversely, if loose soil is encountered such that the attachment drive speed 324 is increased, the attachment multiplier 417 is increased which correspondingly results in an increase in the rate of boom 47 plunging. This action increases the load on the attachment motor 48 and decreases the attachment drive speed 324. By proper adjustment of the control system variables, the attachment drive speed 324 can be maintained in a desired region and the rate of boom 47 plunging can be continuously and automatically adjusted for this purpose.

Provisions allowing the operator to adjust the proportional band 330 by rotating the load control knob 380 provide a benefit enabling the operator to tune the track trencher 30 to a given environment or desired performance. Loading the engine 36 differently uses available horsepower and torque differently and thus allows the trenching results to be varied and tuned. Likewise, provisions allowing the operator to adjust the attachment speed proportional band 460 provide a benefit enabling the operator to further tune the track trencher 30. Loading the attachment motor 48 differently allows the trenching results to be varied and tuned.

Returning now to FIG. 21, a method is illustrated for calculating and storing the calculated boom down current 442. This method uses the attachment multiplier 417 and the load multiplier 317 to provide feedback, as discussed above. Inputs for this method are retrieved in steps 700 through 708 and include the maximum boom current 416 in step 700, the boom drop speed limiter 406 in step 702, the attachment multiplier 417 in step 704, the load multiplier 317 in step 706, and the boom threshold current 402 in step 708. The calculated boom down current 442 is calculated as shown in step 710 and stored. The calculation cycle is then repeated.

FIG. 22 illustrates a method by which the preliminary boom down current 444 and the preliminary boom up current 445 are calculated and stored. This method allows the control system to automatically control the boom position with the goal of achieving and maintaining the desired boom cylinder position 432. Inputs for this method are retrieved in steps 720 through 726 and include the maximum boom current 416 in step 720, the calculated boom down current 442 in step 722, the desired boom cylinder position 432 in step 724, and the actual boom cylinder position 410 in step 726. The actual boom cylinder position 410 is tested in step 728 and if found to be less than the desired boom cylinder position 432, then the preliminary boom down current 444 is set equal to the calculated boom down current 442 in step 730 and stored and the preliminary boom up current 445 is set equal to zero in step 732 and stored. If the result of step 728 is no, the actual boom cylinder position 410 is tested in step 734 and if found to be equal to the desired boom cylinder position 432, then the preliminary boom down current 444 is set equal to zero in step 736 and stored and the preliminary boom up current 445 is set equal to zero in step 738 and stored. If the result of step 734 is no, the actual boom cylinder position 410 is tested in step 740 and if found to be greater than the desired boom cylinder position 432, then the preliminary boom down current 444 is set equal to zero in step 742 and stored and the preliminary boom up current 445 is set equal to the maximum boom current 416 in step 744 and stored. If the result of step 740 is no, then an out of range fault is generated in step 746. The calculation cycle is repeated after the preliminary boom down current 444 and the preliminary boom up current 445 are stored or after step 746. This method may also include and incorporate control system techniques known in the art such as providing a dead band in steps 728, 734, and 740. This method may further include and incorporate such control system techniques as a P-I-D loop to achieve the desired boom cylinder position 432.

FIG. 23 illustrates a method by which the auto-plunge down current 446 and the auto-plunge up current 447 are calculated and stored. This method allows the control system to automatically interrupt the plunge-cutting and/or trenching process and raise the boom 47 when the attachment drive has stalled and resume upon stall recovery. Inputs for this method are retrieved in steps 760 through 766 and include the maximum boom current 416 in step 760, the preliminary boom down current 444 in step 762, the preliminary boom up current 445 in step 764, and the attachment drive speed 324 in step 766. The attachment drive speed 324 is tested in step 768 and if found to be zero, then the auto-plunge down current 446 is set equal to zero in step 770 and stored and the auto-plunge up current 447 is set equal to the maximum boom current 416 in step 772 and stored. If the result of step 768 is no, then the auto-plunge down current 446 is set equal to the preliminary boom down current 444 in step 774 and stored and the auto-plunge up current 447 is set equal to the preliminary boom up current 445 in step 776 and stored. The calculation cycle is then repeated. This method may also include and incorporate control system techniques known in the art such as providing a dead band in step 768.

FIG. 24 illustrates a method by which the boom down current 414 and the boom up current 415 are calculated and stored. This method allows the auto-plunge and automated boom depth control to be enabled. This method also allows the control system to interrupt the auto-plunge and automated boom depth control functions when the operator activates the manual boom control 183 and resume upon deactivation. Furthermore, this method allows the manual boom control 183 functions to be used with the auto-plunge and automated boom depth control functions disabled. Inputs for this method are retrieved in steps 800 through 808 and include the maximum boom current 416 in step 800, the auto-plunge enable switch position 185 in step 802, the manual boom control switch position 183 in step 804, the auto-plunge down current 446 in step 806, and the auto-plunge up current 447 in step 808. The manual boom control switch position 183 is tested in step 810 and if found to be "UP", then the boom down current 414 is set equal to zero in step 812 and stored and the boom up current 415 is set equal to the maximum boom current 416 in step 814 and stored. If the result of step 810 is no, then the manual boom control switch position 183 is tested in step 816 and if found to be "DOWN", then the boom down current 414 is set equal to the maximum boom current 416 in step 818 and stored and the boom up current 415 is set equal to zero in step 820 and stored. If the result of step 816 is no, then the manual boom control switch position 183 is tested in step 822 and if found to be "OFF", then the auto-plunge enable switch position 185 is tested in step 824 and if found to be "ON", then the boom down current 414 is set equal to the auto-plunge down current 446 in step 826 and stored and the boom up current 415 is set equal to the auto-plunge up current 447 in step 828 and stored. If the result of step 824 is no, then the auto-plunge enable switch position 185 is tested in step 830 and if found to be "OFF", then the boom down current 414 is set equal to zero in step 832 and stored and the boom up current 415 is set equal to zero in step 834 and stored. If the result of step 830 is no, then an out of range fault is generated in step 836. If the result of step 822 is no, then an out of range fault is generated in step 838. The calculation cycle is repeated after the boom down current 414 and the boom up current 415 are stored or after steps 836 or 838.

The computer network 182 disclosed in this specification may include one or more computing devices. These computing devices may be physically distributed across the track trencher 30 and may be incorporated within certain components of the track trencher 30, e.g. the engine 36 control system may have a computing device that in incorporated into the computer network 182. The computing devices may be known by various names including controller and computer. The computing devices may be digital or analogue and may be programmable by software.

In certain cases, the above disclosure references a specific system of units when discussing a particular variable, e.g. RPM. It is anticipated that an alternate system of units could be used in each of these cases. It is further anticipated that a transformed system of units could be used where desired, e.g. desired boom cylinder position in percent could be transformed into desired boom position in degrees.

Certain signals are described above and in the figures in terms of specific signal types and units, e.g. the load control signal 308 is described as having a range of 0% to 100% and the controllable valve signals 414 and 415 are described as using milliamperes (mA) of electrical current. Various other signal types and units may be substituted for those described above without departing from the true spirit of the present invention, e.g. the load control signal 308 may be replaced with a pulse-width modulation (PWM) signal. Likewise, these signals may also be transformed from signal type to signal type within the control system itself, e.g. the controllable valve signals 414 and 415 may originate as a digital numeric signal at the computer network 182 and be transformed into a millivolt (mV) signal. These transformations may occur in various locations including within the device generating the signal, within a signal converter, within a controller, and/or within the computer network 182.

The above specification sets forth embodiments of the present invention having various feedback control loops. Many types of loop control are known in the art. Included in these are various methods of error calculation, correction gains, ramp times, delays, value averaging, hysteresis, Proportional-Integral-Derivative, and other mathematical loop control techniques. It is anticipated that certain of these methods may be combined and implemented with the embodiments described above.

The above specification sets forth embodiments of the present invention that receive feedback from the engine 36 and the attachment drive speed 324 for use in controlling the rate of boom 47 movement. Other embodiments of the present invention receive feedback from other parameters, such as the attachment drive pressure 323, that are also used for this purpose.

There is known in the art electric and mechanical actuators. Furthermore, an engine may power the electric and/or mechanical actuator, and the actuator may be operatively connected to a boom. It is anticipated that the above actuator may be substituted for the hydraulic cylinder 43, controllable valve 41, and the supply pump 55 in the above specification. The control system of the current disclosure may be adapted to control the above actuator.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A control system for controlling an actuator used to plunge an excavation attachment into the ground, the excavation attachment powered by an attachment drive having a rotational drive speed, wherein the excavation attachment includes a boom pivotally moveable relative to a vehicle, wherein the attachment drive drives a rotational cutting structure mounted on the boom, and wherein the actuator pivots the boom relative to the vehicle to plunge the excavation attachment, the control system comprising:

an electronic controller that generates an actuator output signal for controlling plunging of the excavation attachment by the actuator, the electronic controller defining a band of rotational drive speeds within which a magnitude of the actuator output signal is automatically increased by the electronic controller with an increasing rotational drive speed of the attachment drive and the magnitude of the actuator output signal is automatically decreased by the electronic controller with a decreasing rotational drive speed of the attachment drive.

2. The control system of claim 1, wherein the attachment drive is a hydrostatic drive.

3. The control system of claim 1, wherein a user interface allows an operator to manually change the band of rotational drive speeds.

4. The control system of claim 1, wherein the attachment drive is powered by an engine having an engine speed, the electronic controller defining a band of engine speeds within which the magnitude of the actuator output signal increases with increasing engine speed and decreases with decreasing engine speed.

5. The control system of claim 4, wherein the attachment drive is a hydrostatic drive.

6. The control system of claim 4, wherein the magnitude of the actuator output signal is zero when the rotational drive speed of the attachment drive is less than rotational drive speeds within the band of rotational drive speeds, wherein the actuator output signal is zero when the engine speed is less than engine speeds within the band of engine speeds, wherein the magnitude of the actuator output signal is a maximum magnitude when the rotational drive speed of the attachment drive is greater than the rotational drive speeds within the band of rotational drive speeds and the engine speed is greater than the engine speeds within the band of engine speeds, and wherein a user interface allows an operator to manually change the band of engine speeds.

7. The control system of claim 6, wherein a width of the band of engine speeds remains constant as the operator changes the band of engine speeds.

8. The control system of claim 6, wherein the user interface includes a dial.

9. The control system of claim 1, wherein the rotational cutting structure comprises a trenching chain.

10. The control system of claim 1, wherein the magnitude of the actuator output signal is zero when the rotational drive speed of the attachment drive is less than rotational drive speeds within the band of rotational drive speeds, wherein the magnitude of the actuator output signal is a maximum magnitude when the rotational drive speed of the attachment drive is greater than the rotational drive speeds within the band of rotational drive speeds, and wherein a user interface allows an operator to manually change the band of engine speeds.

11. The control system of claim 1, wherein the attachment drive is a hydrostatic drive including a hydraulic pump and a hydraulic motor, wherein the magnitude of the actuator output signal is zero when the rotational drive speed of the attachment drive is less than rotational drive speeds within the band of rotational drive speeds, and wherein the magnitude of the actuator output signal is a maximum magnitude when the rotational drive speed of the attachment drive is greater than the rotational drive speeds within the band of rotational drive speeds.

12. The control system of claim 4, wherein the magnitude of the actuator output signal is zero when the rotational drive speed of the attachment drive is less than rotational drive speeds within the band of rotational drive speeds, wherein the actuator output signal is zero when the engine speed is less than engine speeds within the band of engine speeds, wherein the magnitude of the actuator output signal is a maximum magnitude when the rotational drive speed of the attachment drive is greater than the rotational drive speeds within the band of rotational drive speeds and the engine speed is greater than the engine speeds within the band of engine speeds.

13. A control system for controlling an actuator used to plunge a boom of an excavation attachment, the excavation attachment including a rotational cutting structure mounted to the boom, the rotational cutting structure being rotated relative to the boom by an attachment drive having a rotational drive speed, the attachment drive powered by an engine having an engine speed, the control system comprising:

an electronic controller that generates an actuator output signal for controlling plunging of the excavation attachment by the actuator, the electronic controller defining a band of engine speeds within which the electronic controller automatically increases a magnitude of the actuator output signal with increasing engine speed and the electronic controller automatically decreases the magnitude of the actuator output signal with decreasing engine speed, and wherein the electronic controller automatically interrupts the plunging and raises the boom if the rotational drive speed decreases to a predetermined level during the plunging.

14. The control system of claim 13, wherein the attachment drive is a hydrostatic drive.

15. The control system of claim 13, wherein the actuator output signal is zero when the engine speed is less than engine speeds within the band of engine speeds, wherein the magnitude of the actuator output signal is a maximum magnitude when the engine speed is greater than the engine speeds within the band of engine speeds, and wherein a user interface allows an operator to manually change the band of engine speeds.

16. The control system of claim 15, wherein a width of the band of engine speeds remains constant as the operator changes the band of engine speeds.

17. The control system of claim 15, wherein the user interface includes a dial.

18. The control system of claim 13, wherein the rotational cutting structure comprises a trenching chain rotated about the boom by the attachment drive.

* * * * *